US010539913B2

(12) United States Patent
Motoyama

(10) Patent No.: US 10,539,913 B2
(45) Date of Patent: Jan. 21, 2020

(54) CONSUMABLES DISCHARGE DEVICE, IMAGE FORMING APPARATUS, MULTIFUNCTION MACHINE, AND CONSUMABLES DISCHARGE METHOD

(71) Applicant: SHARP KABUSHIKI KAISHA, Sakai, Osaka (JP)

(72) Inventor: Kiyoto Motoyama, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/370,619

(22) Filed: Mar. 29, 2019

(65) Prior Publication Data

US 2019/0310577 A1 Oct. 10, 2019

(30) Foreign Application Priority Data

Apr. 4, 2018 (JP) ..... 2018-072454

(51) Int. Cl.
*G03G 15/08* (2006.01)
*G03G 15/00* (2006.01)
*G03G 15/16* (2006.01)

(52) U.S. Cl.
CPC ..... *G03G 15/556* (2013.01); *G03G 15/08* (2013.01); *G03G 15/0844* (2013.01); *G03G 15/1605* (2013.01); *G03G 15/50* (2013.01)

(58) Field of Classification Search
CPC .. G03G 15/556; G03G 15/08; G03G 15/1605; G03G 15/50; G03G 15/0844
See application file for complete search history.

(56) References Cited

U.S. PATENT DOCUMENTS

2015/0160599 A1* 6/2015 Kamihara ..... G03G 15/1605 399/27

FOREIGN PATENT DOCUMENTS

| | | | |
|---|---|---|---|
| JP | 2000-206744 | A | 7/2000 |
| JP | 2003-270878 | A | 9/2003 |
| JP | 2006-220699 | A | 8/2006 |

* cited by examiner

*Primary Examiner* — Hoang X Ngo
(74) *Attorney, Agent, or Firm* — ScienBiziP, P.C.

(57) ABSTRACT

Provided is a consumables discharge device that discharges toner via an image carrier and an intermediate transfer body including a patch forming unit that forms a patch in a patch printing region to be formed on the intermediate transfer body via the image carrier by using the toner discharged from a developer tank after adjusting a range of the patch printing region in one or both of a gap region existing between image forming regions adjacent to each other of the intermediate transfer body and both end regions adjacent to both ends of an image forming region in a width direction of the intermediate transfer body, based on one or both of a size and a direction of a recording medium to be printed as input information.

18 Claims, 20 Drawing Sheets

CONSUMABLES DISCHARGE DEVICE, IMAGE FORMING APPARATUS, MULTIFUNCTION MACHINE, AND CONSUMABLES DISCHARGE METHOD

BACKGROUND

1. Field

The present disclosure relates to a consumables discharge device, an image forming apparatus, a multifunction machine, and a consumables discharge method.

2. Description of the Related Art

In an electrophotographic image forming apparatus and a multifunction machine including the same, 3 which is not toner desirable for an image formation is discharged from a developer tank of a developing device, and in order to compensate for the shortage due to the discharge, new toner is supplied from a toner cartridge to the developer tank of the developing device, thereby maintaining the quality of the toner.

Japanese Unexamined Patent Application Publication No. 2000-206744 and Japanese Unexamined Patent Application Publication No. 2003-270878 disclose a technique of forcibly discharging toner by forming a patch image in a region between image forming regions adjacent to each other in a conveyance direction of an intermediate transfer body. However, according to these techniques, the throughput of printing lowers. In order to settle this problem, Japanese Unexamined Patent Application Publication No. 2006-220699 discloses a technique of forcibly discharging toner by forming a patch image on both sides of an image forming region in a width direction of an intermediate transfer body (that is, regions at both ends in the width direction of the intermediate transfer body). However, according to the technique disclosed in Japanese Unexamined Patent Application Publication No. 2006-220699, it is not possible to forcibly discharge a sufficient amount of toner in a short time.

Therefore, in this disclosure, it is desirable to provide a consumables discharge device, an image forming apparatus, a multifunction machine, and a consumables discharge method which are able to forcibly discharge a desirable amount of toner in a short time without lowering the throughput of printing.

SUMMARY

According to an aspect of the disclosure, there is provided a consumables discharge device that discharges toner via an image carrier and an intermediate transfer body, including a patch forming unit that forms a patch in a patch printing region to be formed on the intermediate transfer body via the image carrier by using the toner discharged from a developer tank after adjusting a range of the patch printing region in one or both of a gap region existing between image forming regions adjacent to each other of the intermediate transfer body and both end regions adjacent to both ends of an image forming region in a width direction of the intermediate transfer body, based on one or both of a size and a direction of a recording medium to be printed as input information. A distance between the recording media adjacent to each other on the intermediate transfer body is known and a width of the intermediate transfer body is also known.

According to another aspect of the disclosure, there is provided a multifunction machine including the above-described consumables discharge device.

According to still another aspect of the disclosure, there is provided an image forming apparatus including the above-described consumables discharge device.

According to still another aspect of the disclosure, there is provided a consumables discharge method that discharges toner via an image carrier and an intermediate transfer body, including forming a patch in a patch printing region to be formed on the intermediate transfer body via the image carrier by using the toner discharged from a developer tank after adjusting a range of the patch printing region in one or both of a gap region existing between image forming regions adjacent to each other of the intermediate transfer body and both end regions adjacent to both ends of an image forming region in a width direction of the intermediate transfer body, based on one or both of a size and a direction of a recording medium to be printed as input information.

According to still another aspect of the disclosure, there is provided a storage medium storing a program that causes a computer to function as the above-described consumables discharge device.

DESCRIPTION OF THE EMBODIMENTS

Hereinafter, embodiments that carry out the present disclosure will be described in detail with reference to the drawings.

First Embodiment

Figure 1:
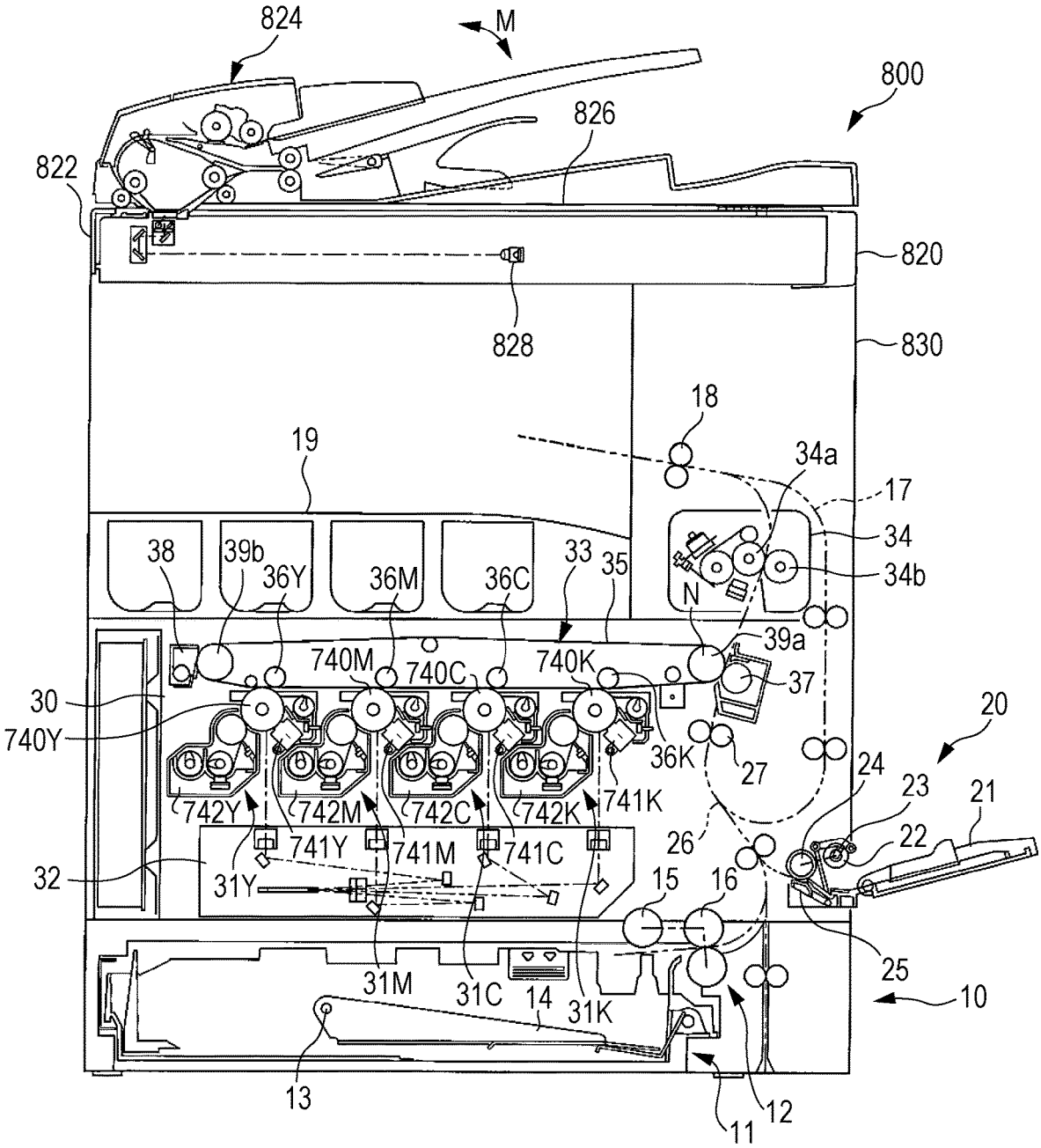
FIG. 1 is a conceptual sectional diagram of a multifunction machine according to a first embodiment of the present disclosure.
Figure 2:
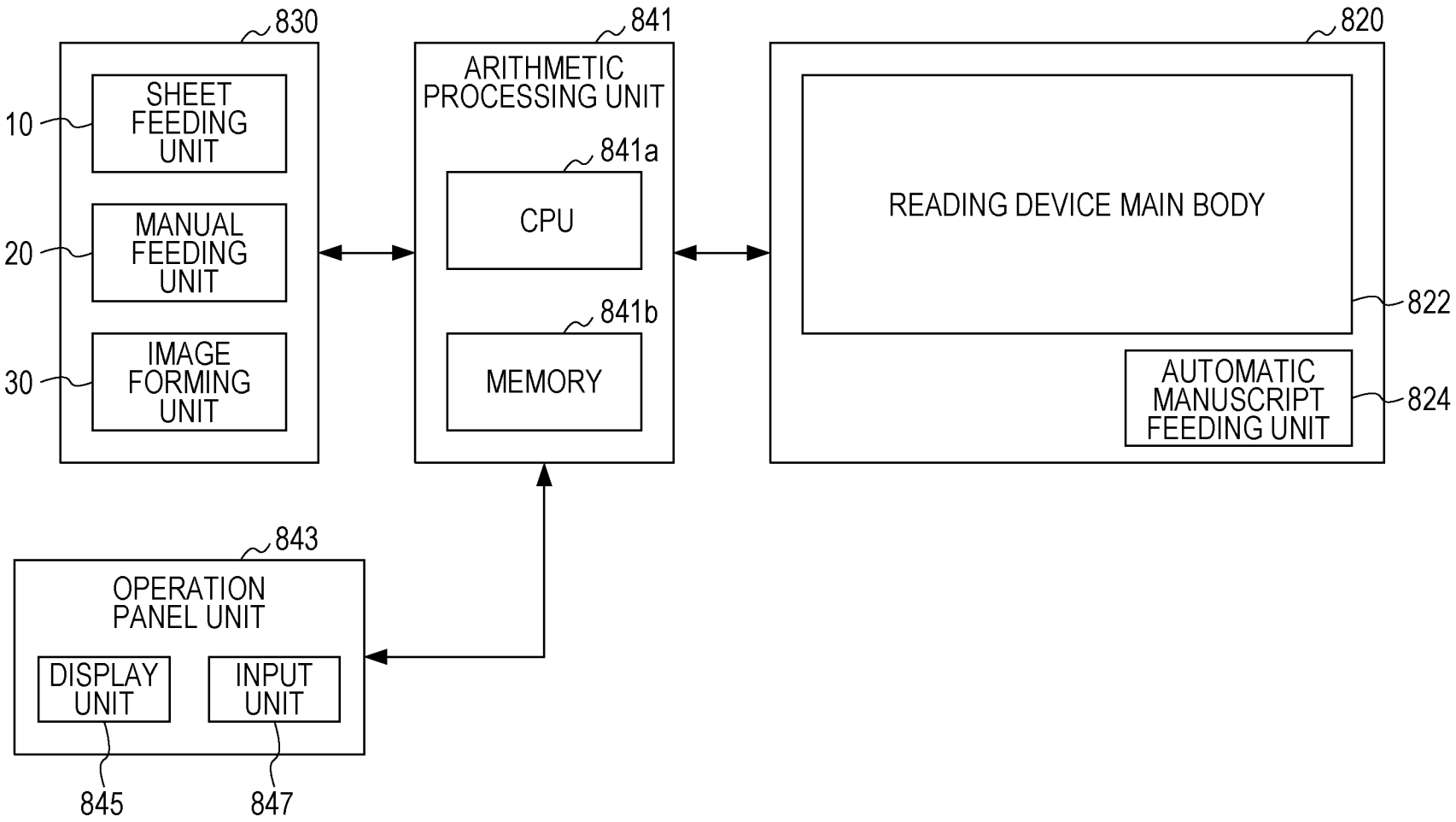
FIG. 2 is a functional block diagram of the multifunction machine according to the first embodiment of the present disclosure.

A first embodiment relates to a multifunction machine 800. FIGS. 1 and 2 show the configuration of the multifunction machine 800, or the like.

As shown in FIGS. 1 and 2, the multifunction machine 800 includes a manuscript reading device 820 that reads an image of a manuscript, a multifunction machine main body (image forming unit main body) 830 that forms an image on a sheet, an operation panel unit 843 that operates the manuscript reading device 820 and the multifunction machine main body 830, and an arithmetic processing unit 841 that controls the manuscript reading device 820 and the multifunction machine main body 830 based on the operation panel unit 843.

Besides using the manuscript reading device 820 alone for reading an image and using the multifunction machine main body 830 alone for forming an image, the manuscript reading device 820 and the multifunction machine main body 830 can be interlocked with each other for copying an image. The multifunction machine 800 may include a storage device and a facsimile device (not shown). The storage device can store an image read by the manuscript reading device 820 or an image received by the facsimile device. The facsimile device can transmit an image read by the manuscript reading device 820 and an image stored in the storage device, and can receive an image from outside. Further, the multifunction machine 800 may include an interface that connects to a personal computer via a network. The personal computer connected to the multifunction machine 800 can use a function of the multifunction machine with respect to data that can be managed by the personal computer.

The manuscript reading device 820 includes an automatic manuscript feeding unit SPF (single pass feeder) 824 for automatically feeding a manuscript, and a reading device main body 822 for reading an image of a manuscript. Note that in addition to components shown in FIG. 2, the manuscript reading device 820 also includes components shown in FIG. 1 which are not shown in FIG. 2. Further, as shown in FIG. 1, the reading device main body 822 is provided with a manuscript table 826.

The multifunction machine main body 830 includes a sheet feeding unit 10 for feeding a sheet, a manual feeding unit 20 for manually feeding a sheet, and an image forming unit 30 for forming an image on a sheet fed by the sheet feeding unit 10 or the manual feeding unit 20.

The sheet feeding unit 10 includes a sheet stacking unit 11 for stacking sheets and a separation feeding unit 12 for separating and feeding the sheets stacked on the sheet stacking unit 11 one by one. The sheet stacking unit 11 includes a middle plate 14 that revolves around a rotation shaft 13, and the middle plate 14 revolves when feeding the sheet and lifts the sheet upward. The separation feeding unit 12 includes a pickup roller 15 for feeding the sheet lifted by the middle plate 14 and a pair of separation rollers 16 for separating the sheets fed by the pickup roller 15 one by one.

The manual feeding unit 20 includes a manual feeding tray 21 capable of stacking sheets and a separation feeding unit 22 for separating and feeding the sheets stacked on the manual feeding tray 21 one by one. The manual feeding tray 21 is supported by the multifunction machine main body 830 in a rotatable manner, and sheets can be stacked by fixing the manual feeding tray 21 at a predetermined angle when performing a manual feeding. The separation feeding unit 22 includes a pickup roller 23 for feeding the sheet stacked on the manual feeding tray 21, and a separation roller 24 and a separation roller pad 25 for separating the sheets fed by the pickup roller 23 one by one.

The image forming unit 30 includes four process cartridges 31Y to 31K for forming images of yellow (Y), magenta (M), cyan (C), and black (K), and photosensitive drums 740Y to 740K to be described later, an exposure device 32 for exposing surfaces of the process cartridges and the photosensitive drums, a transfer unit 33 for transferring toner images formed on the surfaces of the photosensitive drums 740Y to 740K onto a sheet, and a fixing unit 34 for fixing the transferred toner images on the sheet. Note that the alphabets (Y, M, C, K) attached at the end of the reference numerals indicate the respective colors (yellow, magenta, cyan, black).

Each of the four process cartridges 31Y to 31K is configured so that it can be detachable from the multifunction machine main body 830 and is replaceable. Note that since the four process cartridges 31Y to 31K have the same configuration except that the colors of the images to be formed are different, only the configuration of the process cartridge 31Y for forming an image of yellow (Y) will be described, and description of the process cartridges 31M to 31K will be omitted.

The process cartridge 31Y includes a photosensitive drum 740Y as an image carrier, a charger 741Y for charging the photosensitive drum 740Y, a developing device 742Y for developing an electrostatic latent image formed on the photosensitive drum 740Y, and a drum cleaner for removing toner remaining on a surface of the photosensitive drum 740Y. The developing device 742Y includes a developing device main body (not shown in detail) for developing the photosensitive drum 740Y and a toner cartridge (not shown in detail) for supplying toner to the developing device main body. The toner cartridge is configured so that it can be attachable to and detachable from the developing device main body, and is able to be removed from the developing device main body and replaced when the accommodated toner is exhausted.

The exposure device 32 includes a light source (not shown) in which the photosensitive drums are irradiated with laser beam, a plurality of mirrors (not shown) for guiding the laser beam to the photosensitive drums 740Y to 740K, and the like. The transfer unit 33 includes an intermediate transfer belt 35 as an intermediate transfer body that carries toner images formed on the photosensitive drums 740Y to 740K, primary transfer rollers 36Y to 36K that primarily transfer the toner images formed on the photosensitive drums 740Y to 740K to the intermediate transfer belt 35, a secondary transfer roller 37 that secondarily transfers the toner image transferred to the intermediate transfer belt 35 to the sheet, and a belt cleaner 38 that removes toner remaining on the intermediate transfer belt 35. The intermediate transfer belt 35 is wound around a driving roller 39*a* and a driven roller 39*b* and is pressed against the photosensitive drums 740Y to 740K by the primary transfer rollers 36Y to 36K. The secondary transfer roller 37 nips the intermediate transfer belt 35 with the driving roller 39*a*, and transfers the toner image carried by the intermediate transfer belt 35 to the sheet at a nip portion N. The fixing unit 34 includes a heating roller 34*a* for heating the sheet and a pressure roller 34*b* pressed against the heating roller 34*a*.

The operation panel unit 843 includes a display unit 845 for displaying predetermined information and an input unit 847 for a user to input instructions to the manuscript reading device 820 and the multifunction machine main body 830. In the present embodiment, the operation panel unit 843 is disposed on a front surface side of the reading device main body 822. Note that the front surface side corresponds to a front side when viewed on a paper of FIG. 1, and a rear surface side corresponds to a back side of FIG. 1.

As shown in FIG. 2, the arithmetic processing unit 841 includes a CPU 841*a* that drives and controls the sheet feeding unit 10, the manual feeding unit 20, the image forming unit 30, and the manuscript reading device 820, and a memory 841*b* that stores various programs for operating the CPU 841*a* and various information used by the CPU 841*a*. The arithmetic processing unit 841 integrally controls the operations of the sheet feeding unit 10, the manual feeding unit 20, the image forming unit 30, and the manuscript reading device 820 based on an operation by a user on the operation panel unit 843, and causes a sheet to form an image.

Next, an image forming operation (image forming control by the arithmetic processing unit 841) by the multifunction machine 800 configured as described above will be described. In the present embodiment, an image forming operation in which the image forming unit 30 forms an image of the manuscript to be read, which is fed by the automatic manuscript feeding unit 824 and read by the reading device main body 822, on a sheet fed by the sheet feeding unit 10, will be described as an example.

When an image formation start signal is transmitted by the user input to the input unit 847 of the operation panel unit 843, the manuscript to be read, which is placed on the automatic manuscript feeding unit 824 by the user, is automatically fed toward a manuscript reading position, and an image is read by the reading device main body 822 at the manuscript reading position.

When the image of the manuscript is read by the reading device main body 822, the exposure device 32 irradiates the photosensitive drums 740Y to 740K with a plurality of laser beams corresponding to each photosensitive drum, based on image information of the read manuscript. At this time, the photosensitive drums 740Y to 740K are charged in advance by the chargers 741Y to 741K, respectively, and respective electrostatic latent images are formed on the photosensitive drums 740Y to 740K by irradiating the photosensitive drums 740Y to 740K with the laser beams corresponding to each photosensitive drum. Thereafter, the electrostatic latent images respectively formed on the photosensitive drums 740Y to 740K, are developed by the developing devices 742Y to 742K, and yellow (Y), magenta (M), cyan (C), and black (K) toner images are formed on the photosensitive drums 740Y to 740K. The toner images of the respective colors formed on the photosensitive drums 740Y to 740K are transferred onto the intermediate transfer belt 35 in a superimposed manner by the primary transfer rollers 36Y to 36K. The toner images (full-color toner images) which are transferred in a superimposed manner, are conveyed to the nip portion N in a state being carried on the intermediate transfer belt 35.

In parallel with the above-described image forming operation, the sheets stacked on the sheet stacking unit 11 are fed to a sheet conveying path 26 by a pickup roller 15 while being separated one by one by the separation feeding unit 12. Skew feeding is corrected by a pair of registration rollers 27 on an upstream side of the nip portion N in a sheet conveyance direction, and the sheets are conveyed to the nip portion N at a predetermined conveying timing. By the secondary transfer roller 37, a full-color toner image carried by the intermediate transfer belt 35 is transferred onto the sheet conveyed to the nip portion N.

The sheet on which the toner image is transferred, is heated and pressed by the fixing unit 34 so that the toner image is fused and fixed, and is discharged outside the device by a pair of discharge rollers 18. The sheet discharged outside the device is stacked on a discharged sheet stacking unit 19.

Note that when images are formed on both sides (a first surface and a second surface) of a sheet, before the sheet on which the image is formed on the first surface is discharged to the outside of the device, the pair of discharge rollers 18 is rotated reversely, conveys the sheet to a duplex conveying path 17 and re-conveys the sheet to the image forming unit 30 via the duplex conveying path 17. Then, similarly to the first surface, an image is formed on the second surface and discharged outside the device. The sheet discharged outside the device is stacked on a discharged sheet stacking unit 19.

When patch printing is performed during printing, a latent image corresponding to a print image and a latent image corresponding to the patch printing are simultaneously formed on a surface of the photosensitive drum 740 corresponding to a color to be patch printed. Based on the latent images, a toner image corresponding to the print image and a toner image corresponding to the patch printing are formed on the surface of the photosensitive drum 740 by the developing device 742. These toner images are transferred to the intermediate transfer belt 35. Then, the toner image corresponding to the print image is transferred from the intermediate transfer belt 35 to a recording paper when passing through the nip portion N. A toner image corresponding to the patch printing that remains on the intermediate transfer belt 35 even after passing through the nip portion N, is removed from the intermediate transfer belt 35 by a belt cleaner 38.

Further, when patch printing is performed by interrupting the printing job, a latent image corresponding to the patch printing is formed on the surface of the photosensitive drum 740 corresponding to a color to be patch printed. Based on the latent image, a toner image corresponding to the patch printing is formed on the surface of the photosensitive drum 740 by the developing device 742. The toner image is transferred to the intermediate transfer belt 35. Then, a toner image corresponding to the patch printing that remains on the intermediate transfer belt 35 even after passing through the nip portion N, is removed from the intermediate transfer belt 35 by a belt cleaner 38.

If toner in the developer tank of the developing device main body is used to form a toner image corresponding to patch printing on the surface of the photosensitive drum 740, in order to compensate for the toner, new toner is replenished from a toner cartridge to the developer tank which is in the developing device main body.

Therefore, the quality of the developer in the developer tank of the developing device main body can be increased by performing the patch printing.

Second Embodiment

In a second embodiment, patch printing is executed based on a cumulative number of printed sheets or a development rotational number counter, when it is determined that a toner ejection is desirable. Here, the cumulative number of printed sheets and the development rotational number counter are those after replacing the developer in the developer tank.

Figure 3:
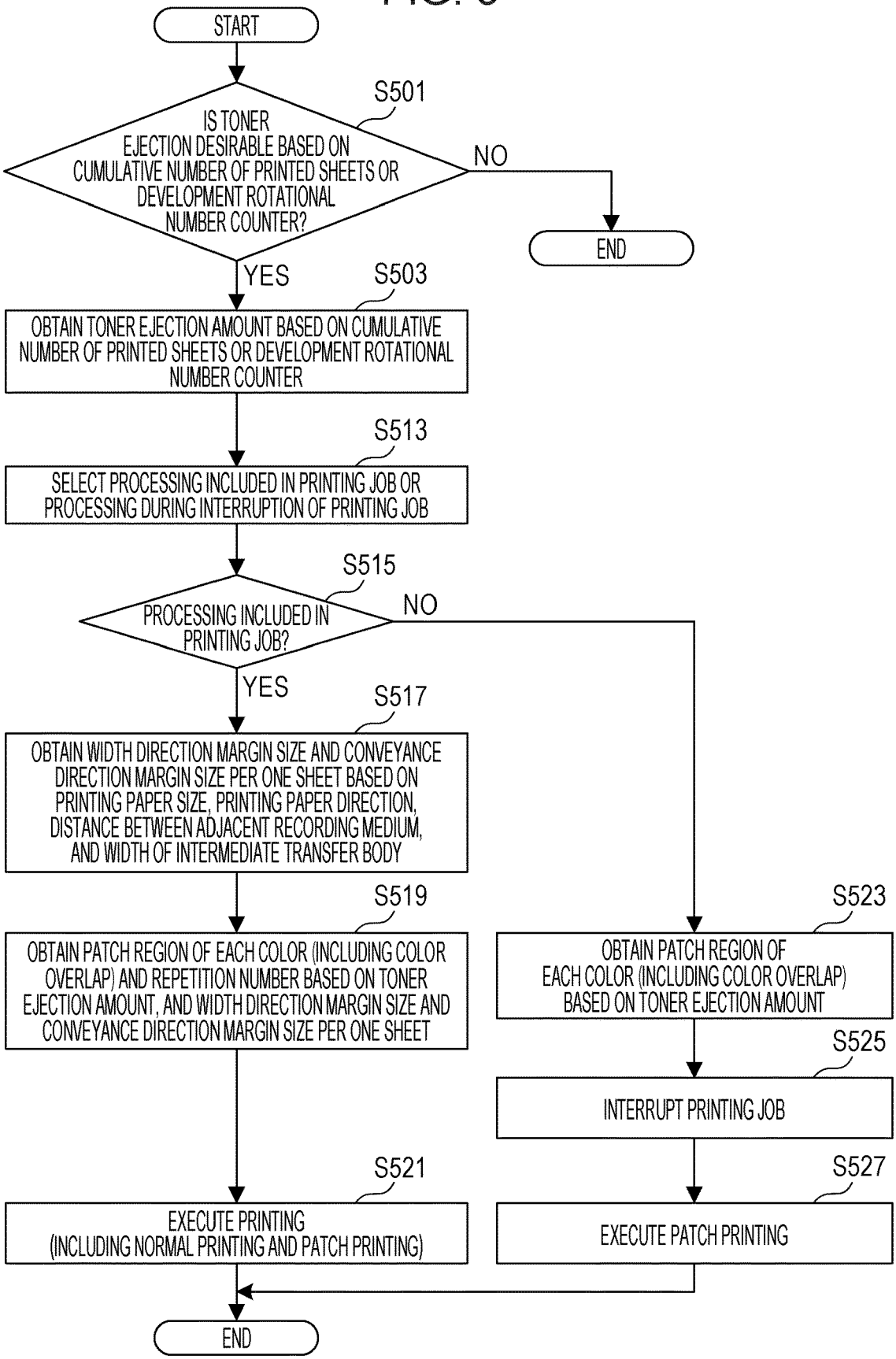
FIG. 3 is a flowchart that explains a discharge method of toner according to a second embodiment of the present disclosure.

FIG. 3 is a flowchart for explaining a discharge method of toner according to the second embodiment. Referring to FIG. 3, in the discharge method, first, it is determined whether or not a toner ejection is desirable based on the cumulative number of printed sheets or the development rotational number counter (step S501).

If a toner ejection is undesirable (NO in step S501), the processing is ended. For example, if the cumulative number of printed sheets or a numerical value of the development rotational number counter is less than a predetermined value, it is determined that a toner ejection is undesirable.

If a toner ejection is desirable (YES in step S501), a toner ejection amount is obtained based on the cumulative number of printed sheets or the development rotational number counter (step S503). As a tendency, if a cumulative number of printed sheets or a numerical value of the development rotational number counter is large, a toner ejection amount is increased, and if the cumulative number of printed sheets or the numerical value of the development rotational number counter is small and the latest average printing ratio is low, the toner ejection amount is reduced, but it is not limited to this.

Next, one of processing included in the printing job or processing during the interruption of the printing job is selected (step S513). As a tendency, if a desirable toner ejection amount is small, the processing included in the printing job is selected, and if the desirable toner ejection amount is large, the processing during the interruption of the printing job is selected, but it is not limited to this. Next, if the processing included in the printing job is selected (YES in step S515), a width direction margin size and a conveyance direction margin size per one sheet are obtained based on a printing paper size, a printing paper direction, a distance between the recording media adjacent to each other on the intermediate transfer body, and the width of the intermediate transfer body (step S517). Here, referring to FIG. 9A, a lateral size and a longitudinal size of a printing paper on the intermediate transfer body can be obtained by using a printing paper size and a printing paper direction, a width direction margin size can be obtained by using the width of the intermediate transfer body and the lateral size, and the conveyance direction margin size can be obtained by using a distance between the recording media adjacent to each other on the intermediate transfer body and the longitudinal size. The distance between the recording media adjacent to each other on the intermediate transfer body can be obtained from the number of sheets fed per unit time and a moving speed of the intermediate transfer body.

Since a width size of the intermediate transfer body is already known when a model of the multifunction machine is determined, on the premise of this, a width direction margin size and a conveyance direction margin size per one sheet can be obtained based on one or both of a printing paper size and a printing direction, and a distance between the recording media adjacent to each other on the intermediate transfer body. Also, a distance between the recording media adjacent to each other on the intermediate transfer body and a width size of the intermediate transfer body may already be known when a model of the multifunction machine is determined, in this case, on the premise of this, a width direction margin size and a conveyance direction margin size per one sheet can be obtained based on one or both of a printing paper size and a printing direction. If it is determined that a printing paper is not changed either longitudinally or laterally in a model of a specific multifunction machine, a width direction margin size and a conveyance direction margin size per one sheet can be obtained based only on a printing paper size, and if it is determined that a printing paper size is not changed in a model of a specific multifunction machine, a width direction margin size and a conveyance direction margin size per one sheet can be obtained based only on a direction of the printing paper.

Next, a patch region of each color and a repetition number are obtained based on the toner ejection amount, and the width direction margin size and the conveyance direction margin size per one sheet (step S519). Here, the patch regions of a plurality of colors may overlap each other. Specifically, a patch region of each color and a number of repetitions are obtained so that a desirable toner ejection amount can be ejected by repeating patch printing with respect to the patch regions for each color by the repetition number.

Next, printing including normal printing and patch printing is executed (step S521).

On the other hand, if the processing during the interruption of the printing job is selected (NO in step S515), the patch region of each color is obtained based on the toner ejection amount (step S523).

Next, the printing job is interrupted (step S525), and the patch printing is executed (step S527).

According to the second embodiment, the patch printing is executed based on the cumulative number of printed sheets or the development rotational number counter, when it is determined that a toner ejection is desirable. For example, the patch printing is executed when the cumulative number of printed sheets become N, 2N, 3N, . . . . Or, the patch printing is executed when the development rotational number counter becomes M, 2M, 3M, . . . . In this way, new toner can be replenished to the developer tank regularly from the toner cartridge, so that the quality of the developer which is inside the developer tank can be maintained.

Third Embodiment

In a third embodiment, patch printing is executed based on the latest average printing ratio when it is determined that a toner ejection is desirable.

Figure 4:
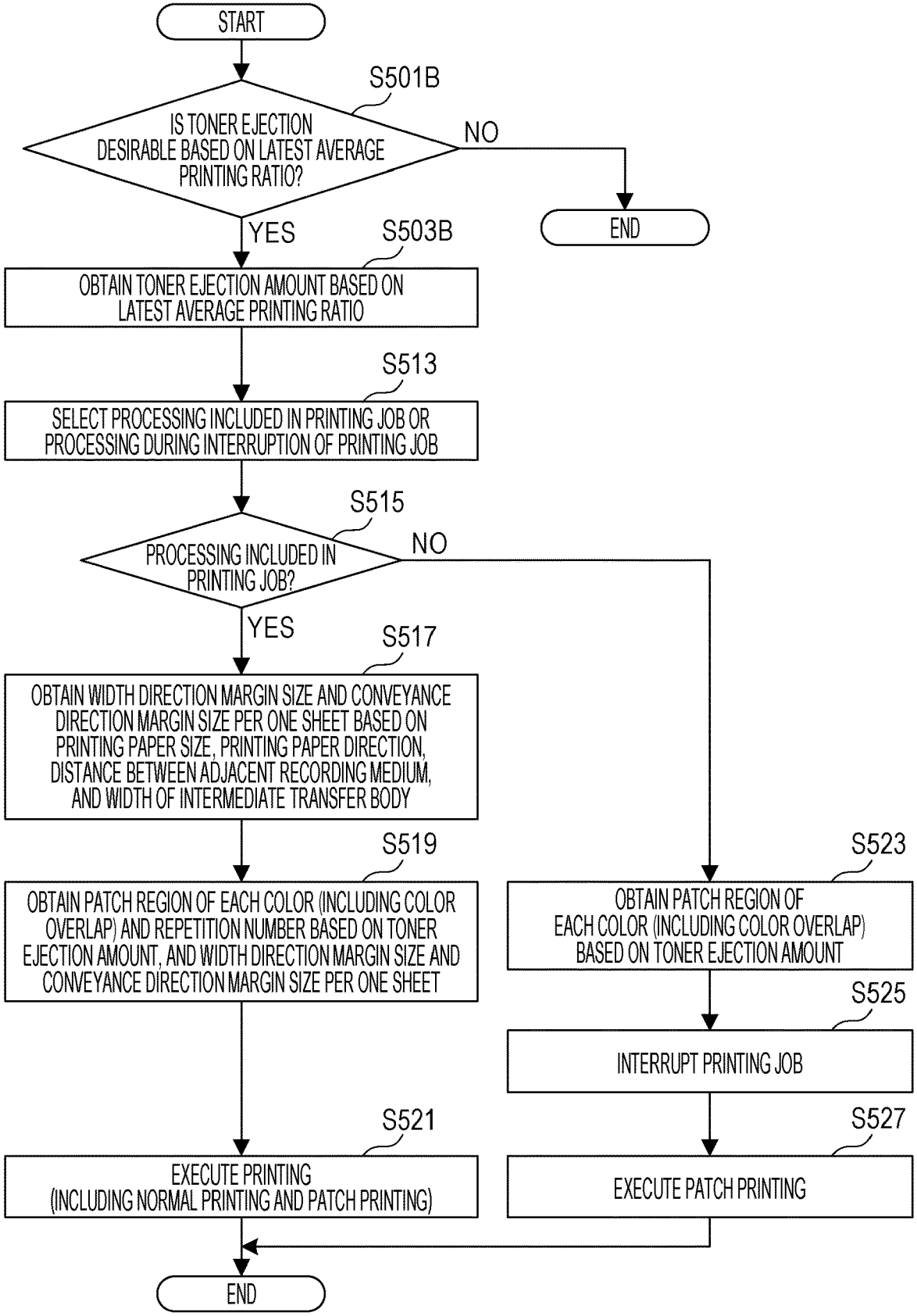
FIG. 4 is a flowchart that explains a discharge method of toner according to a third embodiment of the present disclosure.

FIG. 4 is a flowchart for explaining a discharge method of toner according to the third embodiment. The method according to the third embodiment differs from the method according to the second embodiment only in that step S501 and step S503 are replaced with step S501B and step S503B, respectively, and therefore, descriptions of steps other than step S501B and step S503B are omitted.

In step S501B, it is determined whether or not an ejection is desirable based on the latest average printing ratio.

If a toner ejection is undesirable (NO in step S501B), the processing is ended. For example, if the latest average printing ratio is less than the predetermined value, it is determined that a toner ejection is undesirable.

If a toner ejection is desirable (YES in step S501B), a toner ejection amount is obtained based on the latest average printing ratio (step S503B). As a tendency, if the latest average printing ratio is high, a toner ejection amount is increased, and if the latest average printing ratio is low, the toner ejection amount is reduced, but it is not limited to this.

When the printing ratio is low, the toner used for actual printing is low and the number of reused toner is increased, so there is a possibility that the quality of the developer deteriorates. Therefore, new toner can be replenished from the toner cartridge to the developer tank by forcibly discharging the toner by the patch printing when the latest average printing ratio is low, and the quality of the developer can be maintained.

Fourth Embodiment

In a fourth embodiment, patch printing is executed based on a continuous drive time retraced to the past from the present, when it is determined that a toner ejection is desirable.

Figure 5:
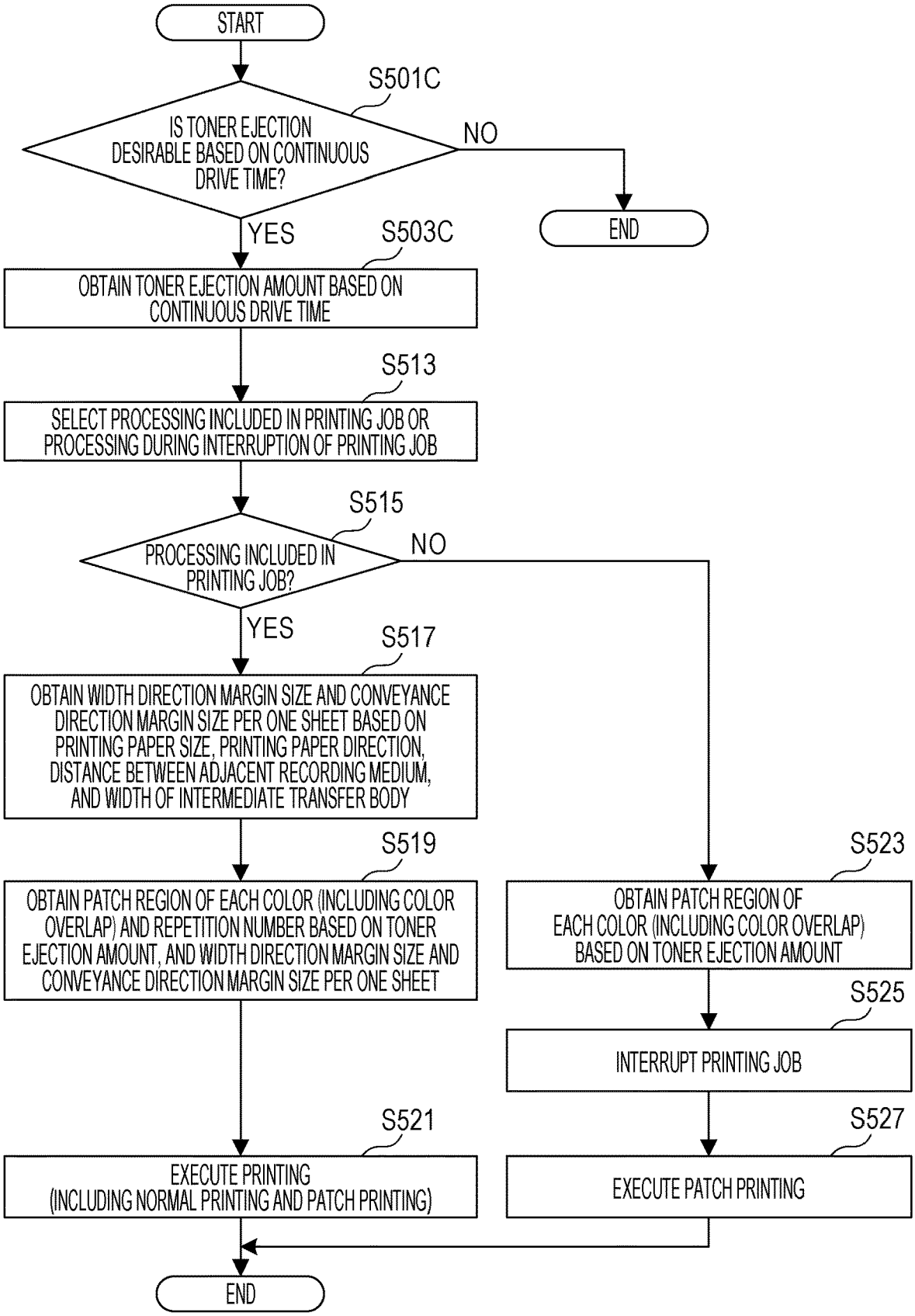
FIG. 5 is a flowchart that explains a discharge method of toner according to a fourth embodiment of the present disclosure.

FIG. 5 is a flowchart for explaining a discharge method of toner according to the fourth embodiment. The method according to the fourth embodiment differs from the method according to the second embodiment only in that step S501 and step S503 are replaced with step S501C and step S503C, respectively, and therefore, descriptions of steps other than step S501C and step S503C are omitted.

In step S501C, it is determined whether or not the ejection is desirable based on the continuous drive time retraced to the past from the present.

If a toner ejection is undesirable (NO in step S501C), the processing is ended. For example, if the continuous drive time retraced to the past from the present, is less than a predetermined value, it is determined that a toner ejection is undesirable.

If the toner ejection is desirable (YES in step S501C), a toner ejection amount is obtained based on the continuous drive time retraced to the past from the present (step S503C). As a tendency, if a continuous drive time retraced to the past from the present is long, a toner ejection amount is increased, and if the continuous drive time retraced to the past from the present is short, the toner ejection amount is reduced, but it is not limited to this.

If the continuous drive time retraced to the past from the present is long, there is a possibility that supply of new toner is not able to catch up with consumption of toner and the quality of the developer in the developer tank is deteriorating. Therefore, new toner can be replenished from the toner cartridge to the developer tank by forcibly discharging the toner by the patch printing when the continuous drive time retraced to the past from the present is long, and the quality of the developer can be maintained.

Fifth Embodiment

According to a fifth embodiment, the patch printing is executed based on the cumulative number of printed sheets or the development rotational number counter, and the latest average printing ratio and the continuous drive time retraced to the past from the present, when it is determined that the toner ejection is desirable.

Figure 6A:
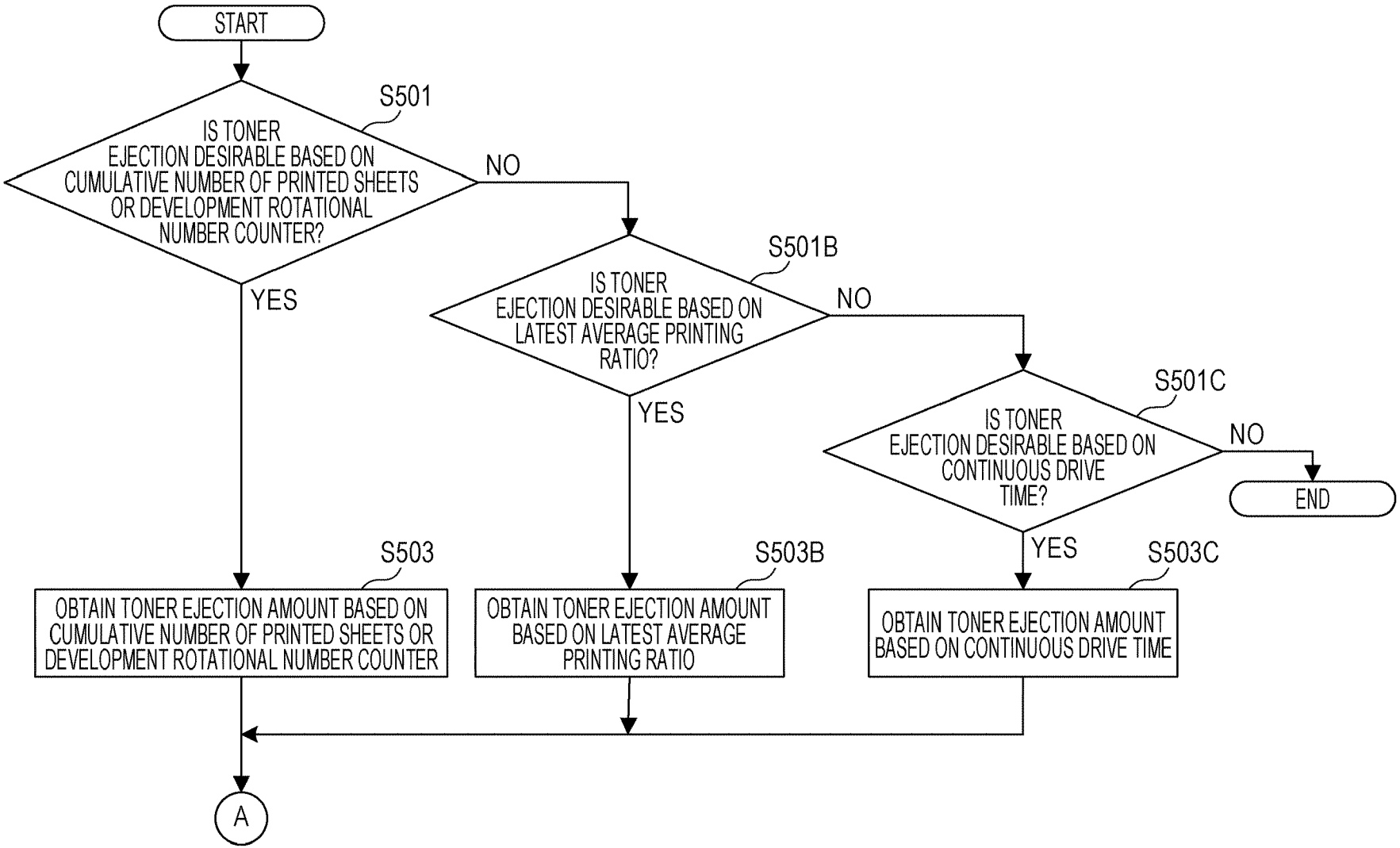
FIG. 6A is a flowchart that explains a discharge method of toner according to a fifth embodiment of the present disclosure.
Figure 6B:
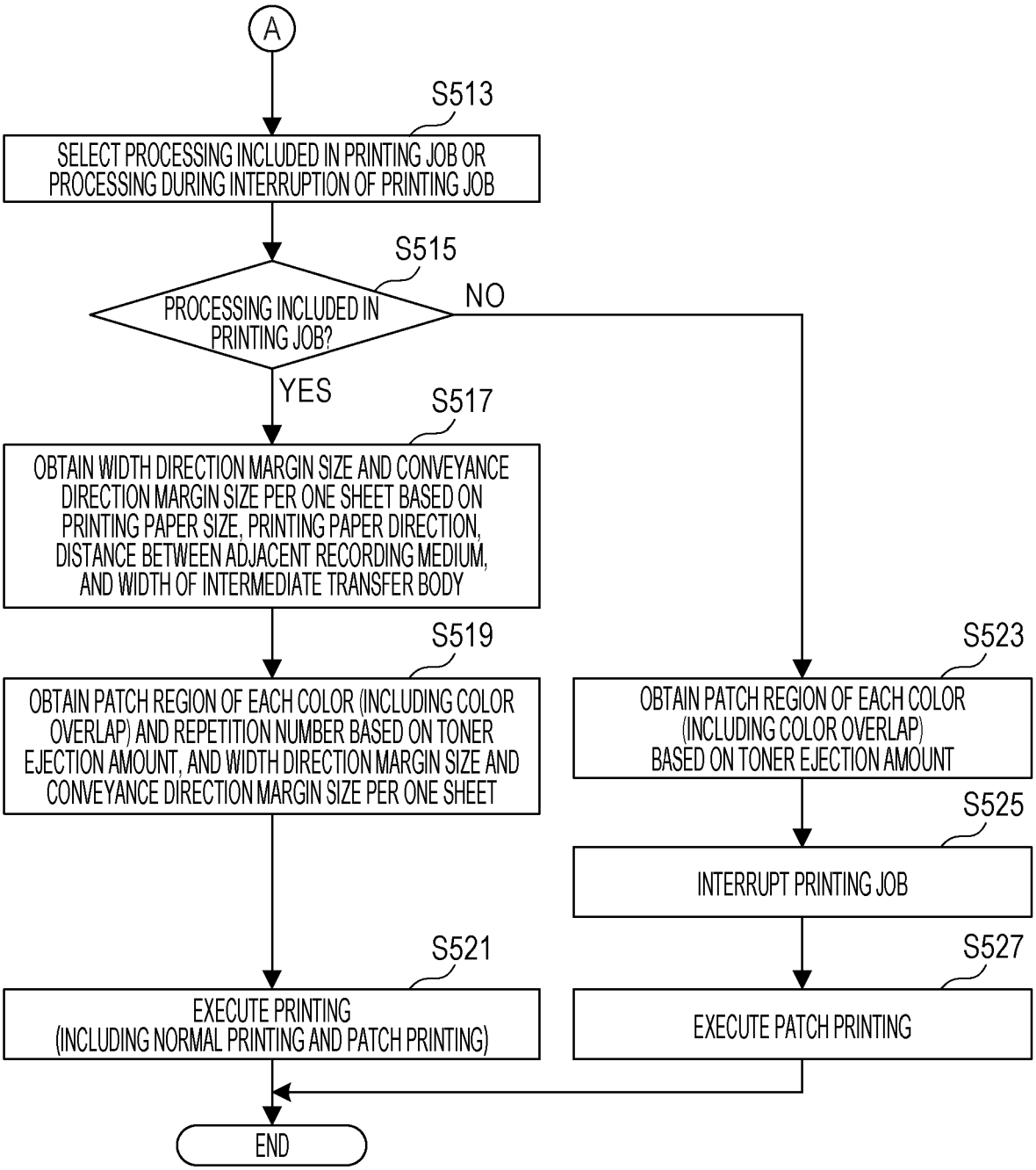
FIG. 6B is another flowchart that explains a discharge method of toner according to the fifth embodiment of the present disclosure.

FIGS. 6A and 6B are flowcharts for explaining a discharge method of toner according to the fifth embodiment. The method according to the fifth embodiment differs from the method according to the second embodiment only in that step S501 and step S503 are replaced with steps S501, S501B, and S501C, and steps S503, S503B, and S503C, respectively, and therefore, descriptions of steps other than steps S501, S501B, and S501C, and steps S503, S503B, and S503C are omitted.

First, a determination as to whether or not a toner ejection is desirable based on the cumulative number of printed sheets or the development rotational number counter (step S501), a determination as to whether or not a toner ejection is desirable based on the latest average printing ratio (step S501B), and a determination as to whether or not a toner ejection is desirable based on the continuous drive time going back from the present to the past (step S501C), are performed.

If it is determined that a toner ejection is desirable in any step (YES in steps S501, S501B or S501C), a toner ejection amount is obtained in the corresponding step (step S503, S503B or S503C). Then, the processing proceeds to step S513.

Note that the above three determinations may be performed regularly or may be performed cyclically in a continuous manner. Also, the order of these determinations may be interchanged. Further, even if it is determined that a toner ejection is desirable in steps S501, S501B or S501C for a certain period after the patch printing, next patch printing may be skipped.

Sixth Embodiment

Figure 7:
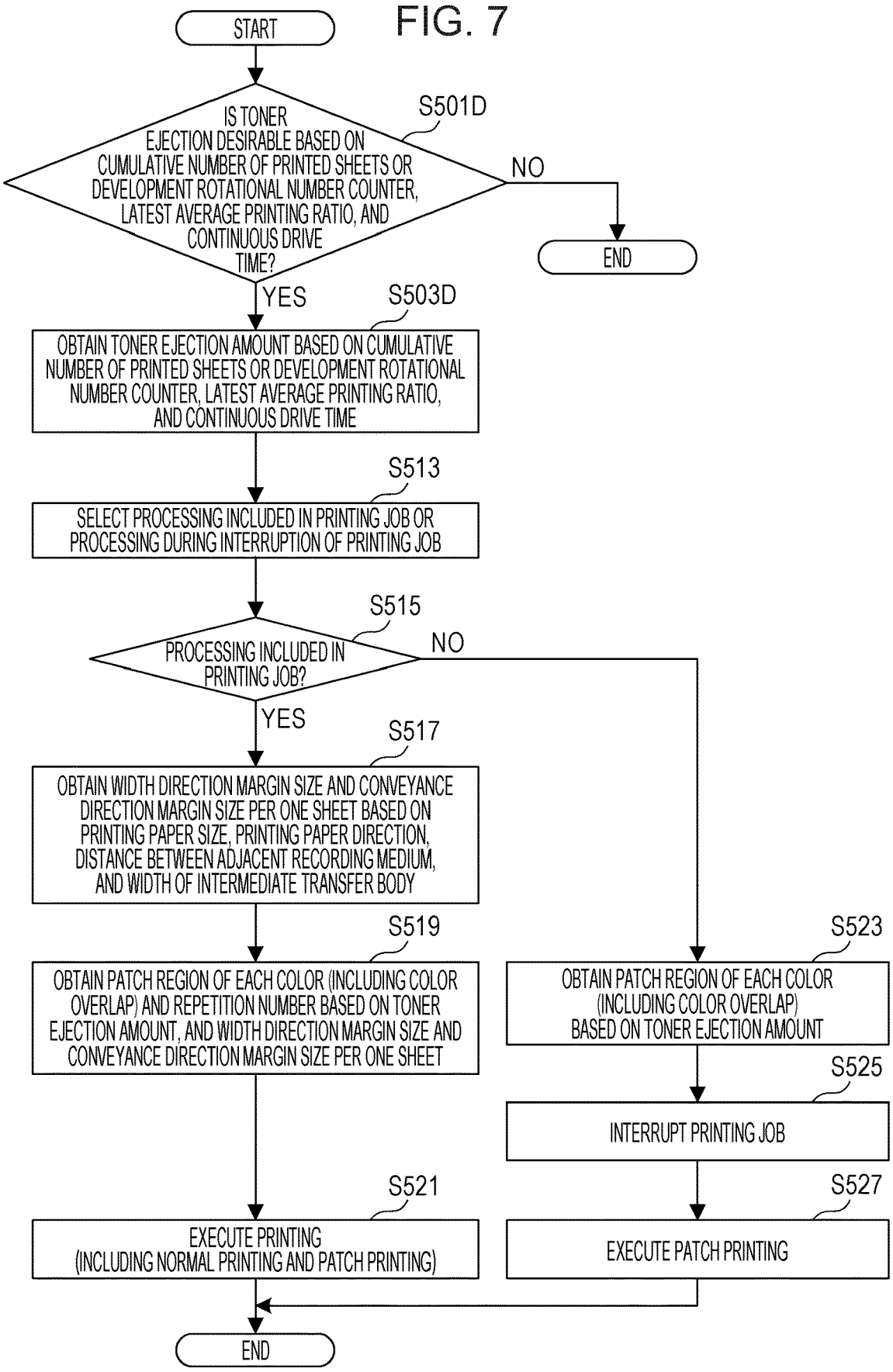
FIG. 7 is a flowchart that explains a discharge method of toner according to a sixth embodiment of the present disclosure.

According to a sixth embodiment, similar to the fifth embodiment, patch printing is executed based on the cumulative number of printed sheets or the development rotational number counter, and the latest average printing ratio and the continuous drive time retraced to the past from the present, when it is determined that a toner ejection is desirable. In the fifth embodiment, a determination as to whether or not a toner ejection is desirable based on the cumulative number of printed sheets or the development rotational number counter (step S501), a determination as to whether or not an ejection is desirable based on the latest average printing ratio (step S501B), and a determination as to whether or not an ejection is desirable based on the continuous drive time retraced to the past from the present (step S501C) are performed independently. However, in the sixth embodiment, as shown in FIG. 7, a determination as to whether or not a toner ejection is desirable is performed synthetically based on the cumulative number of printed sheets or the development rotational number counter, the latest average printing ratio and the continuous drive time retraced to the past from the present, and if it is determined that the toner ejection is desirable (YES in step S501D), a toner ejection amount is obtained based on these three types of factors (step S503D).

For example, a determination as to whether or not a toner ejection is desirable, is performed using a predetermined equation in which the toner ejection amount obtained based on the cumulative number of printed sheets or the development rotational number counter, the toner ejection amount obtained based on the latest average printing ratio, and the toner ejection amount obtained based on the continuous drive time retraced to the past from the present, are set as three input parameters. It may be determined that a toner ejection is desirable if a weighted average of the three input parameters exceeds a threshold value. It may also be determined that a toner ejection is desirable if coordinates corresponding to values of the three parameters in a three-dimensional space spanned by the three input parameters are in a predetermined region of the three-dimensional space. Further, desirable toner ejection amounts corresponding to the three parameters may be written in a three-dimensional table (table of three inputs and one output), a desirable toner ejection amount is obtained based on these three parameters and the table, and if the desirable toner ejection amount exceeds a threshold value, a toner ejection may be executed. Further, desirability/undesirability of toner ejections corresponding to the three parameters and toner amounts when desirable may be written in a three-dimensional table (table of three inputs and two outputs), and desirability/undesirability of a toner ejection and a toner ejection amount when desirable may be obtained based on these three parameters and the table.

Seventh Embodiment

In a seventh embodiment, patch printing is executed based on a future average printing ratio when it is determined that a toner ejection is desirable. Contents of an image to be printed are examined when a printing job is received, and based on this, the future average printing ratio can be obtained.

Figure 8:
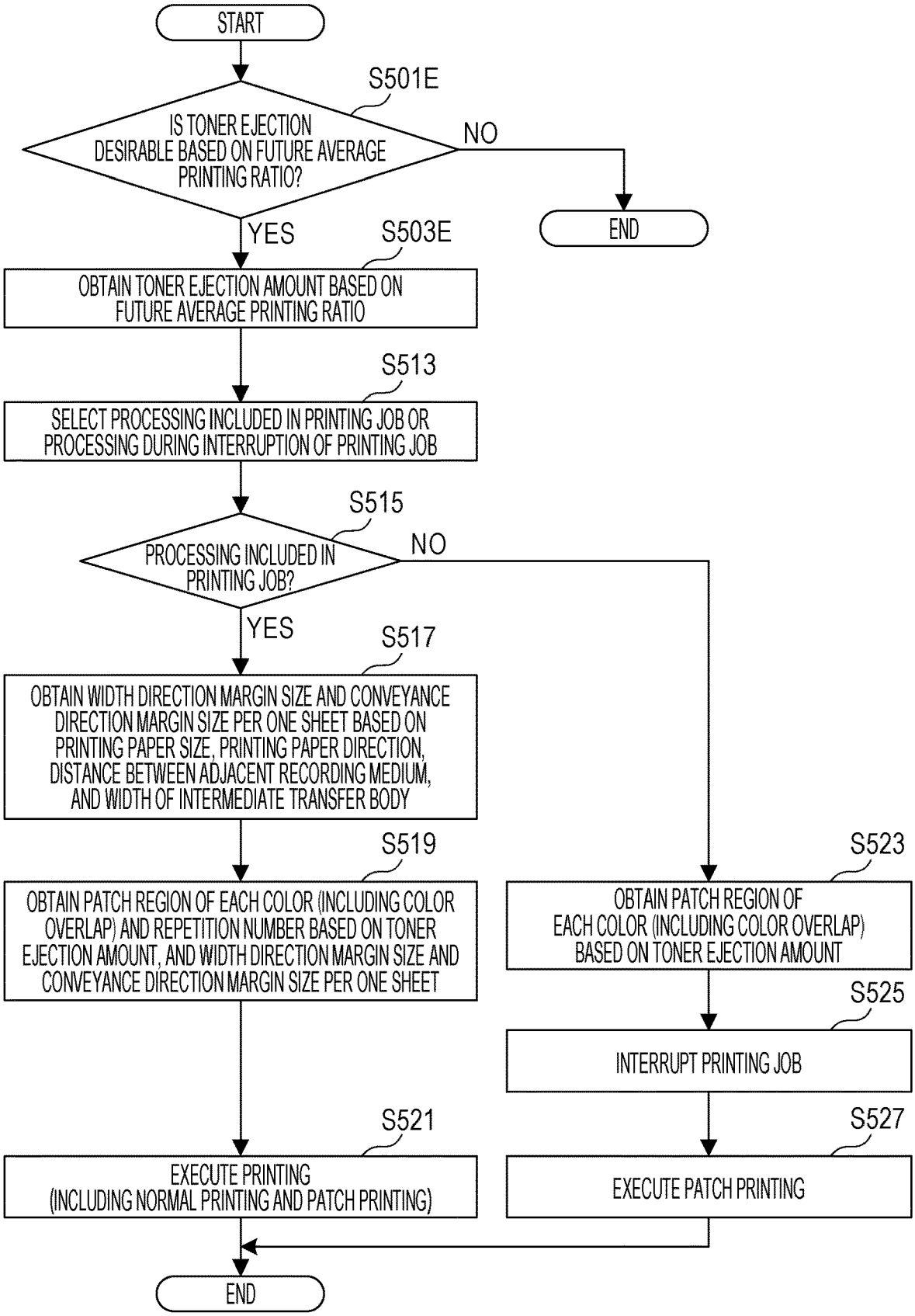
FIG. 8 is a flowchart that explains a discharge method of toner according to a seventh embodiment of the present disclosure.

FIG. 8 is a flowchart for explaining a discharge method of toner according to the seventh embodiment. The method according to the seventh embodiment differs from the method according to the second embodiment only in that step S501 and step S503 are replaced with step S501E and step S503E, respectively, and therefore, descriptions of steps other than step S501E and step S503E are omitted.

In step S501E, it is determined whether or not an ejection is desirable based on a future average printing ratio.

If a toner ejection is undesirable (NO in step S501E), the processing is ended. For example, if the future average printing ratio is less than a predetermined value, it is determined that a toner ejection is undesirable.

If a toner ejection is desirable (YES in step S501E), a toner ejection amount is obtained based on the future average printing ratio (step S503E). As a tendency, if the future average printing ratio is high, a toner ejection amount is increased, and if the future average printing ratio is low, the toner ejection amount is reduced, but it is not limited to this.

When the printing ratio is low, the toner used for actual printing is low and the number of reused toner is increased, so there is a possibility that the quality of the developer deteriorates. Therefore, new toner can be replenished from the toner cartridge to the developer tank by forcibly discharging the toner by the patch printing when the future average printing ratio is low, and the quality of the developer can be maintained.

Eighth Embodiment

In the fifth embodiment and the sixth embodiment, the latest average printing ratio may be changed to the future average printing ratio. Further, in the fifth embodiment and the sixth embodiment, steps related to the future average printing ratio may be added.

Ninth Embodiment

The ninth embodiment relates to a range of a patch printing region in patch printing.

Figure 9A:
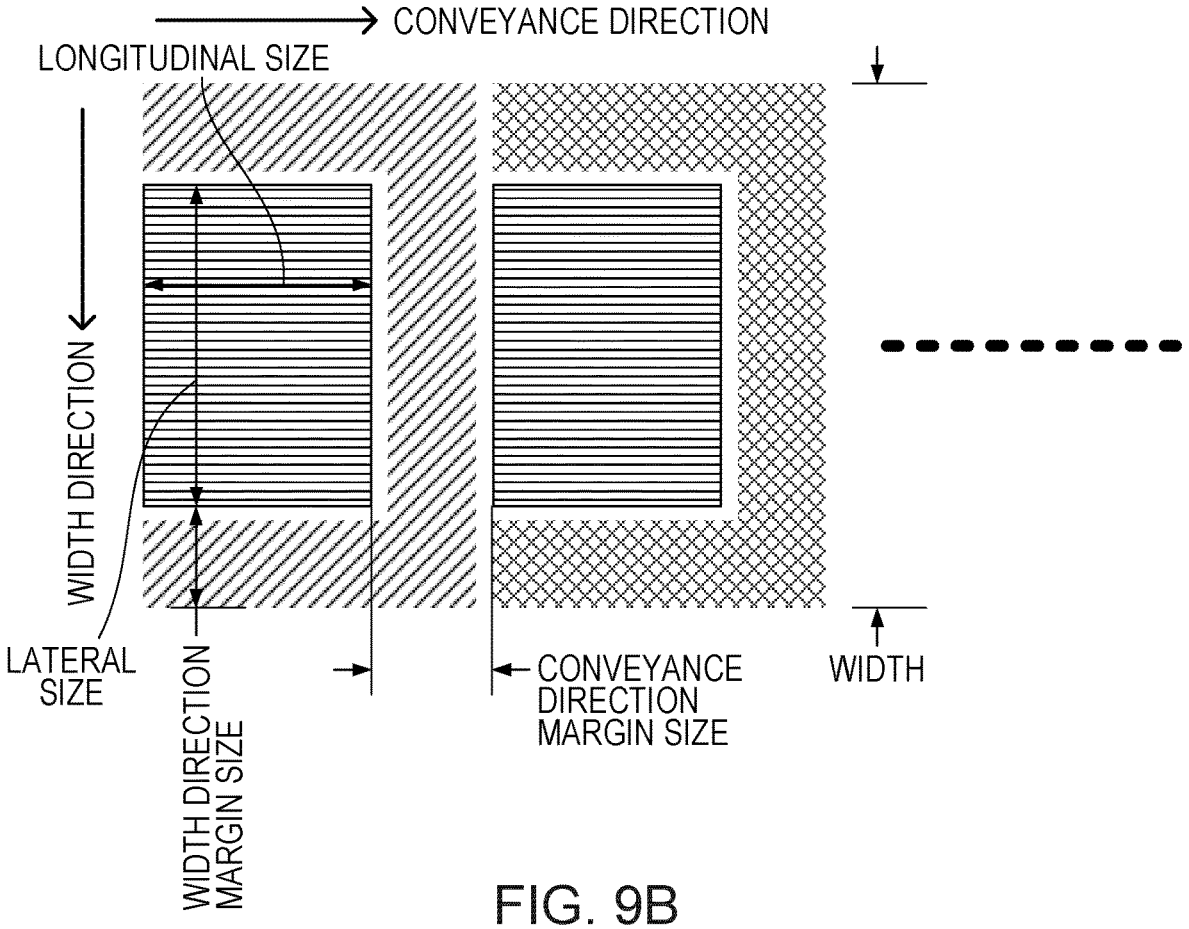
FIG. 9A is a conceptual diagram showing an image forming region and a patch printing region corresponding to an A4 lateral format paper according to a ninth embodiment of the present disclosure.
Figure 9B:
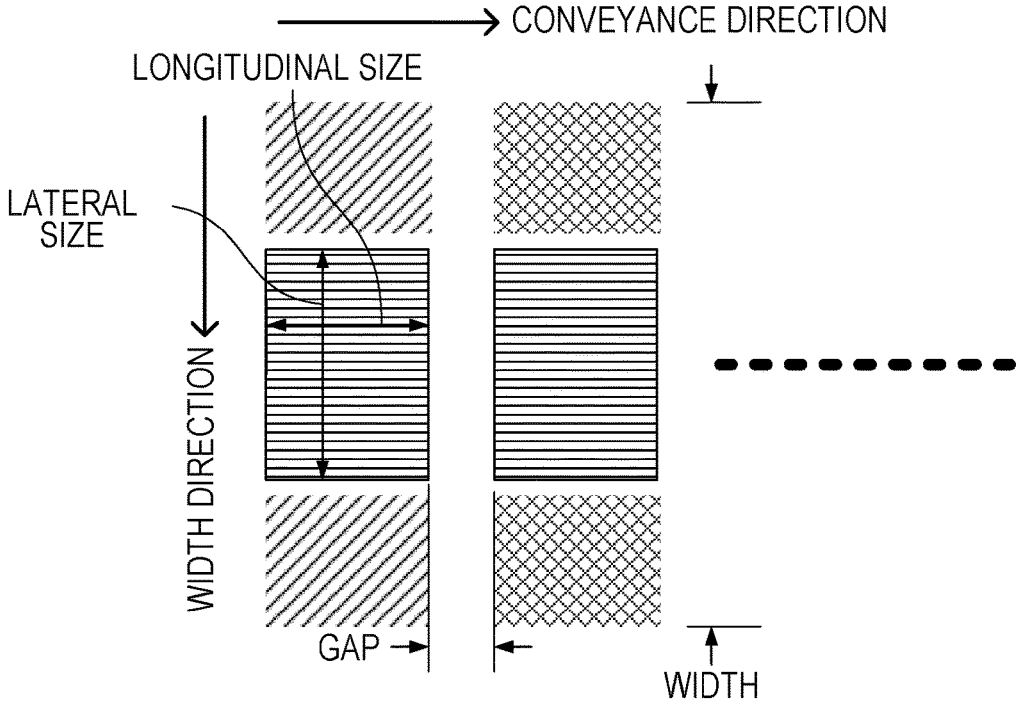
FIG. 9B is a conceptual diagram showing an image forming region and a patch printing region corresponding to an A5 lateral format paper according to the ninth embodiment of the present disclosure.
Figure 9C:
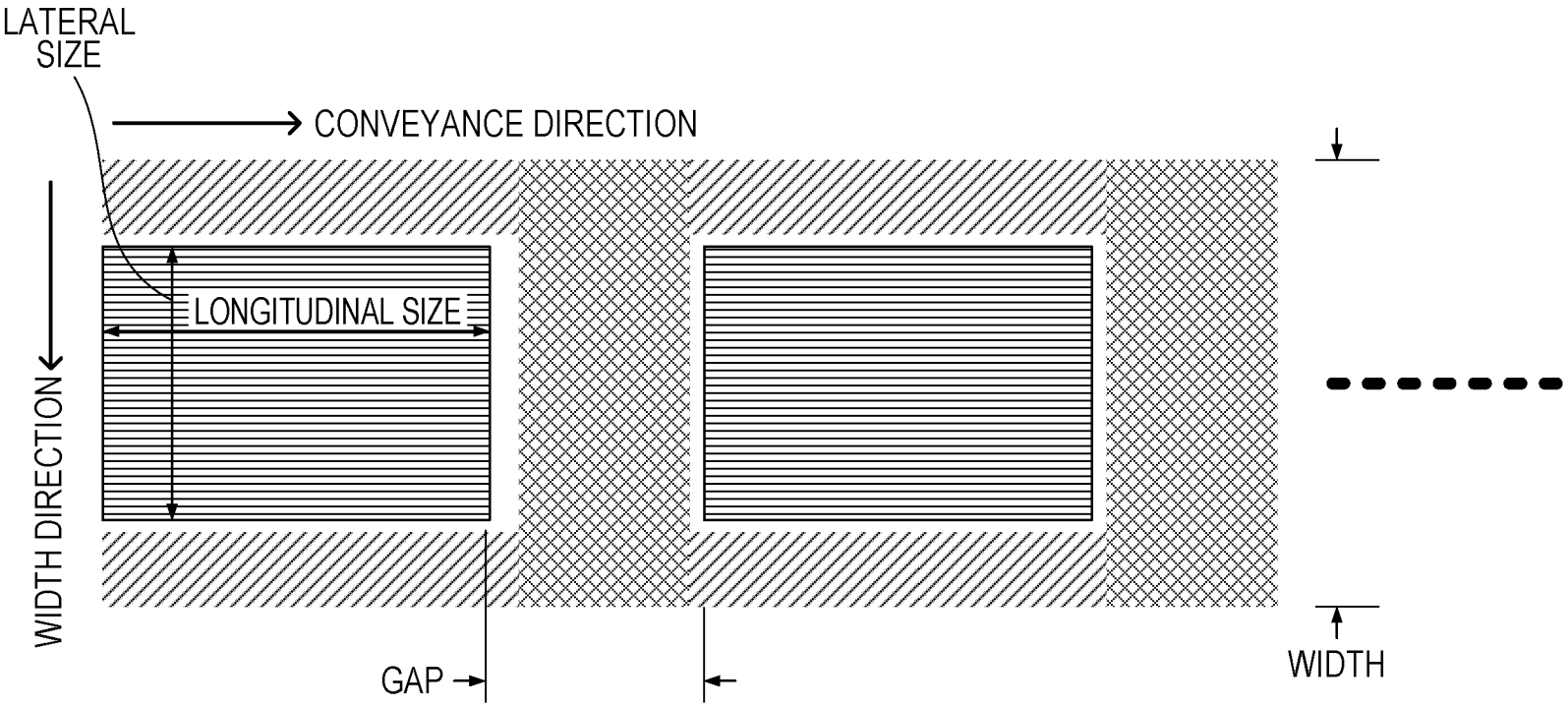
FIG. 9C is a conceptual diagram showing an image forming region and a patch printing region corresponding to an A3 longitudinal format paper according to the ninth embodiment of the present disclosure.

FIG. 9A shows an image forming region and a patch printing region when a paper is A4 lateral format, FIG. 9B shows an image forming region and a patch printing region when a paper is A5 lateral format, and FIG. 9C shows an image forming region and a patch printing region when a paper is A3 longitudinal format.

In FIGS. 9A, 9B, and 9C, a region with lateral hatching is an image forming region, a region with upper right oblique hatching is a patch printing region of magenta (M), and a region with cross hatching is a patch printing region of mixed color of cyan and a yellow (C+Y).

In an example shown in FIG. 9A, range of patch printing regions are provided in both end regions (that is, both end regions in the width direction of the intermediate transfer body) on both sides of the image forming region (a region in which an A4 lateral format paper which is a recording medium to be printed faces the intermediate transfer body) in the width direction (longitudinal direction when viewed from the diagram) of the intermediate transfer body. A range of the patch printing region is also provided in a gap region existing between the recording media adjacent to each other along the conveyance direction of the intermediate transfer body.

Even in a case of normal printing in which patch printing is not performed, a region except for the image forming region has range such that both end regions and the gap region can be provided, therefore, it is possible to provide a gap region for patch printing without lowering a throughput of paper feeding when performing the patch printing.

In FIG. 9A, the both end regions corresponding to the image forming region on the left side and the gap region corresponding to the image forming region on the left side are selected as a patch printing region of magenta (M). Further, the both end regions corresponding to the image forming region on the right side and the gap region corresponding to the image forming region on the right side are selected as a patch printing region of mixed color of cyan and yellow (C+Y). It is repeated with two image forming regions as one cycle.

In an example shown in FIG. 9B, a range of patch printing regions are provided in both end region (that is, both end regions in the width direction of the intermediate transfer body) on both sides of the image forming region (a region in which an A5 lateral format paper which is a recording medium to be printed faces the intermediate transfer body) in the width direction (longitudinal direction when viewed from the diagram) of the intermediate transfer body. However, the range of the patch printing region is not provided in a gap region existing between the recording media adjacent to each other along the conveyance direction of the intermediate transfer body.

Even in a case of normal printing in which patch printing is not performed, a region except for the image forming region has range such that both end regions can be provided but does not have range such that the gap region can be provided, therefore, in order not to lower the throughput of paper feeding when performing the patch printing, a gap region for patch printing is not provided.

In FIG. 9B, the both end regions corresponding to the image forming region on the left side is selected as a patch printing region of magenta (M). Further, the both end regions corresponding to the image forming region on the right side is selected as a patch printing region of mixed color of cyan and yellow (C+Y). It is repeated with two image forming regions as one cycle.

In an example shown in FIG. 9C, range of patch printing regions are provided in both end regions (that is, both end regions in the width direction of the intermediate transfer body) on both sides of the image forming region (a region in which an A3 longitudinal format paper which is a recording medium to be printed faces the intermediate transfer body) in the width direction (longitudinal direction when viewed from the diagram) of the intermediate transfer body. A range of the patch printing region is also provided in a gap region existing between the recording media adjacent to each other along the conveyance direction of the intermediate transfer body.

Even in a case of normal printing in which patch printing is not performed, a region except for the image forming region has range such that both end regions and the gap region can be provided, therefore, it is possible to provide a gap region for patch printing without lowering a throughput of paper feeding when performing the patch printing.

In FIG. 9C, the both end regions corresponding to the image forming region on the left side and the both end regions corresponding to the image forming region on the right side are selected as patch printing regions of magenta (M). Further, the gap region corresponding to the image forming region on the left side and the gap region corresponding to the image forming region on the right side are selected as patch printing regions of mixed color of cyan and yellow (C+Y). It is repeated with two image forming regions as one cycle.

When an area of the both end regions can be increased as in the example of A5 lateral format printing shown in FIG. 9B, it is possible to make the patch printing region only at both end regions. Then, it is possible to increase the throughput of printing without providing a gap region.

When a region between image forming regions adjacent to each other in the conveyance direction is narrow, no gap region for patch printing is provided, but in the example of A4 lateral format printing shown in FIG. 9A and A3 longitudinal format printing shown in FIG. 9C, when a region between image forming regions adjacent to each other in the conveyance direction is wide to some extent, a region other than the image forming region can be effectively used for the patch printing by providing a gap region for the patch printing.

Further, as in the example of A4 lateral format printing shown in FIG. 9A, A5 lateral format printing shown in FIG. 9B and A3 longitudinal format printing shown in FIG. 9C, a region other than the image forming region can be effectively used for patch printing by providing both end regions for the patch printing on both sides of the image forming region in the width direction of the intermediate transfer body.

Note that as shown in FIGS. 9A and 9C, even in a case where both end regions and a gap region can be provided, only one side may be provided.

Figure 10:
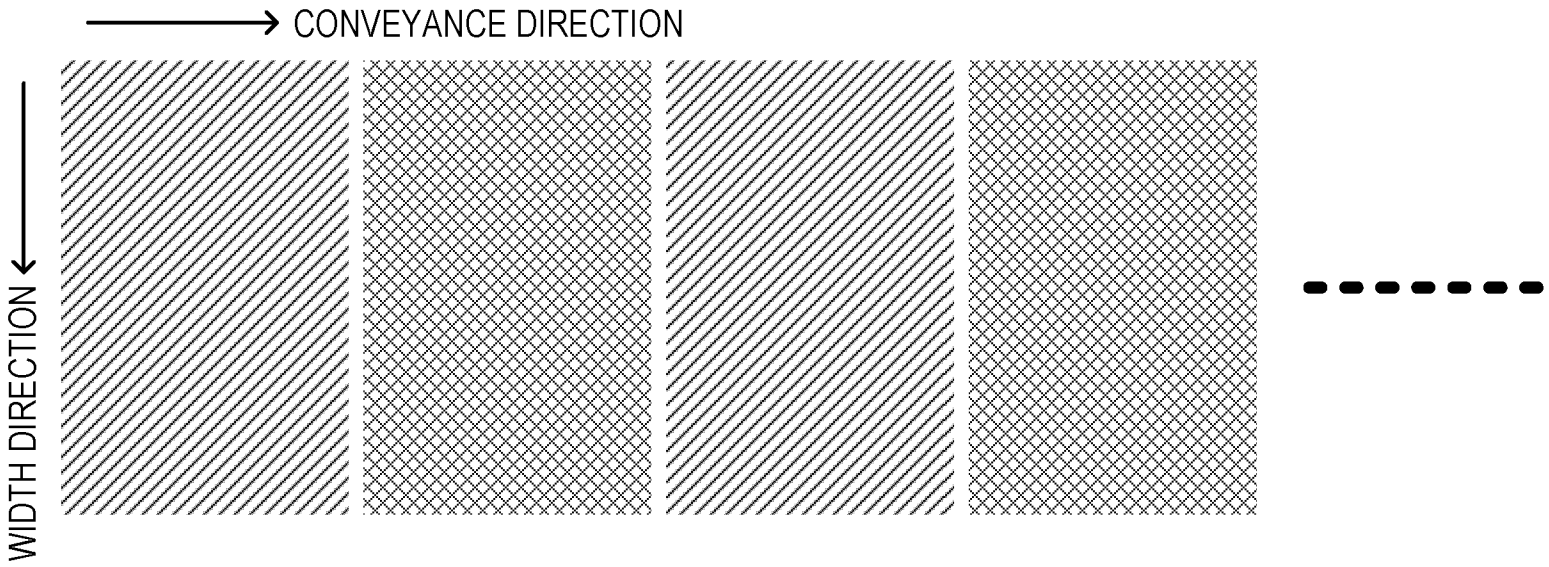
FIG. 10 is a conceptual diagram showing a patch printing region corresponding to patch printing by a job interruption according to the ninth embodiment of the present disclosure.

FIG. 10 shows an example in which the entire surface of the intermediate transfer body is set as a patch printing region after interrupting the printing job. For example, a patch printing region for magenta (M) and a patch printing region for a mixed color of cyan and yellow (C+Y) are repeated with a range of two printing media shown in FIGS. 9A, 9B, and 9C as one cycle.

Figure 11:
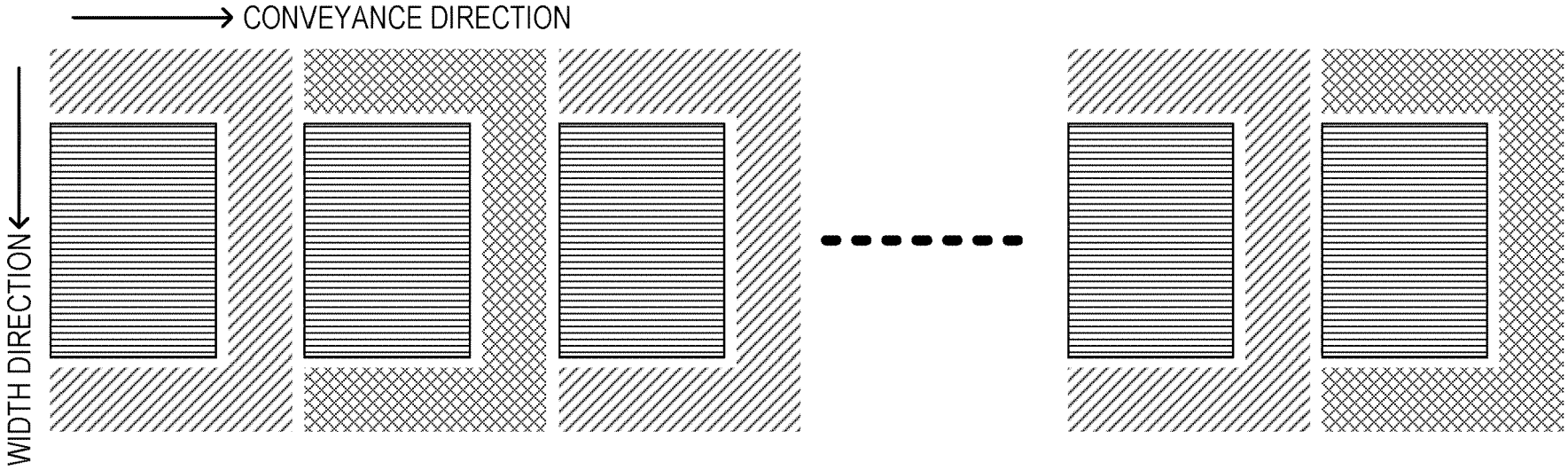
FIG. 11 is a conceptual diagram showing a state in which a pattern of FIG. 9A is repeated.

FIG. 11 shows a state in which the pattern of FIG. 9A is repeated.

Figure 12:
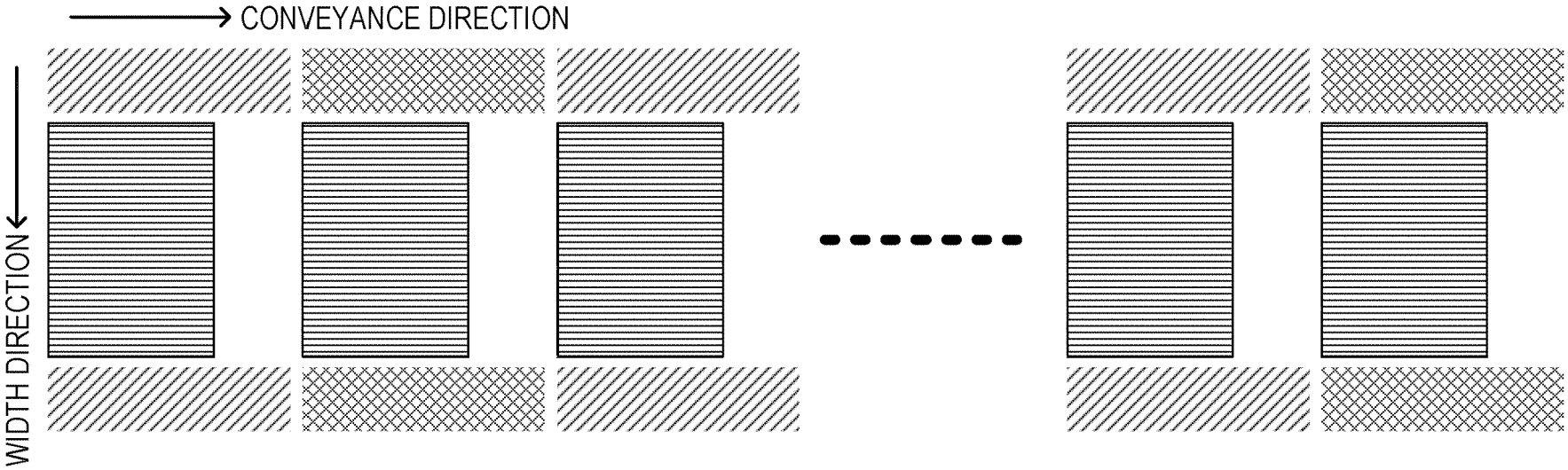
FIG. 12 is a conceptual diagram showing a state in which the pattern of FIG. 9A is modified, is repeated.

FIG. 12 shows a state in which the pattern of FIG. 9A is modified, is repeated. A portion of the gap region is removed.

Figure 13:
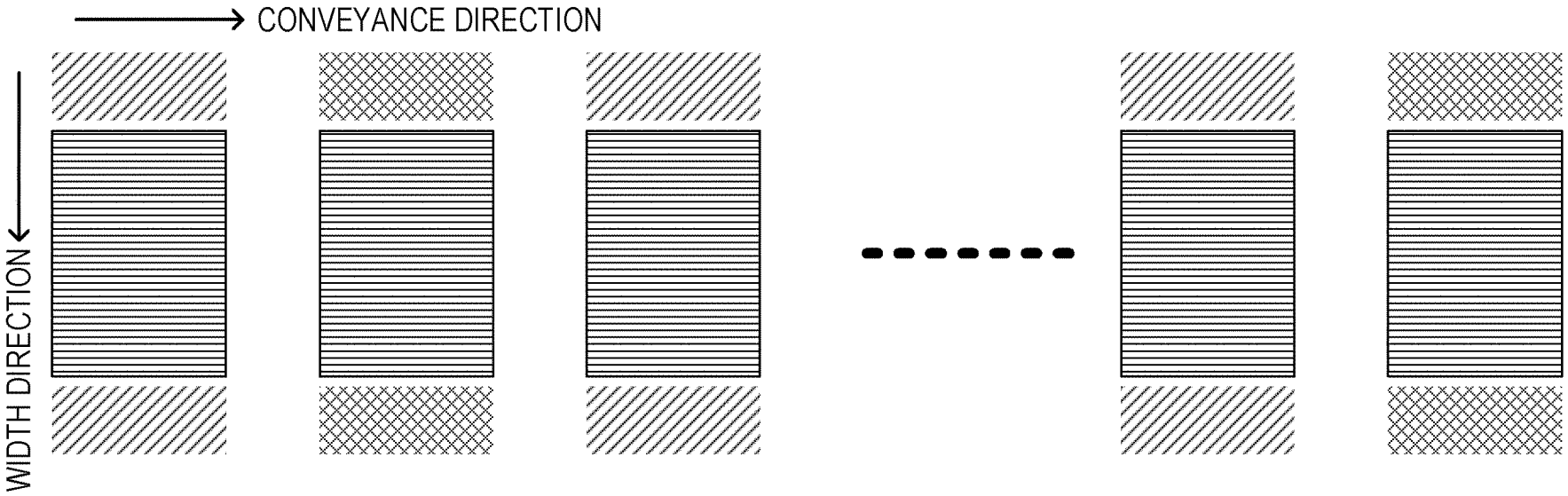
FIG. 13 is a conceptual diagram showing a state in which the pattern of FIG. 9A that is modified in another form is repeated.

FIG. 13 shows a state in which the pattern of FIG. 9A is modified in another form, is repeated. The entire gap region is removed.

Figure 14:
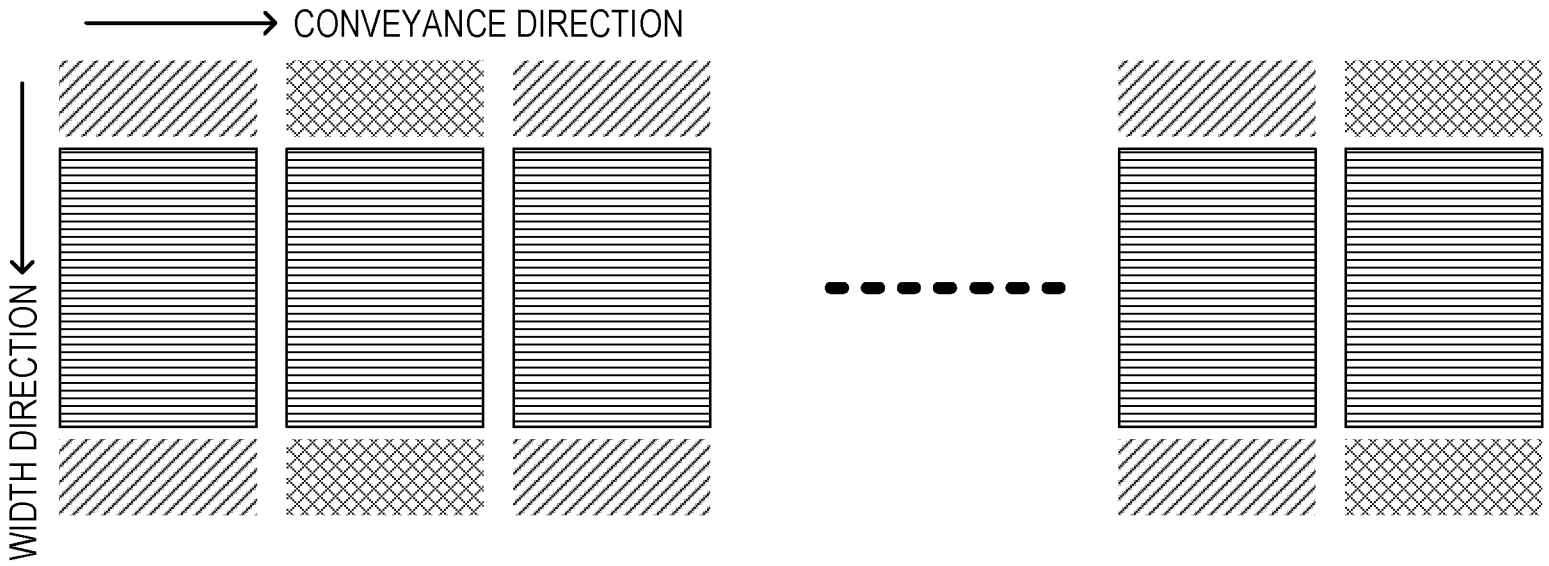
FIG. 14 is a conceptual diagram showing a state in which a pattern of FIG. 9B is repeated.

FIG. 14 shows a state in which the pattern of FIG. 9B is repeated.

Figure 15:
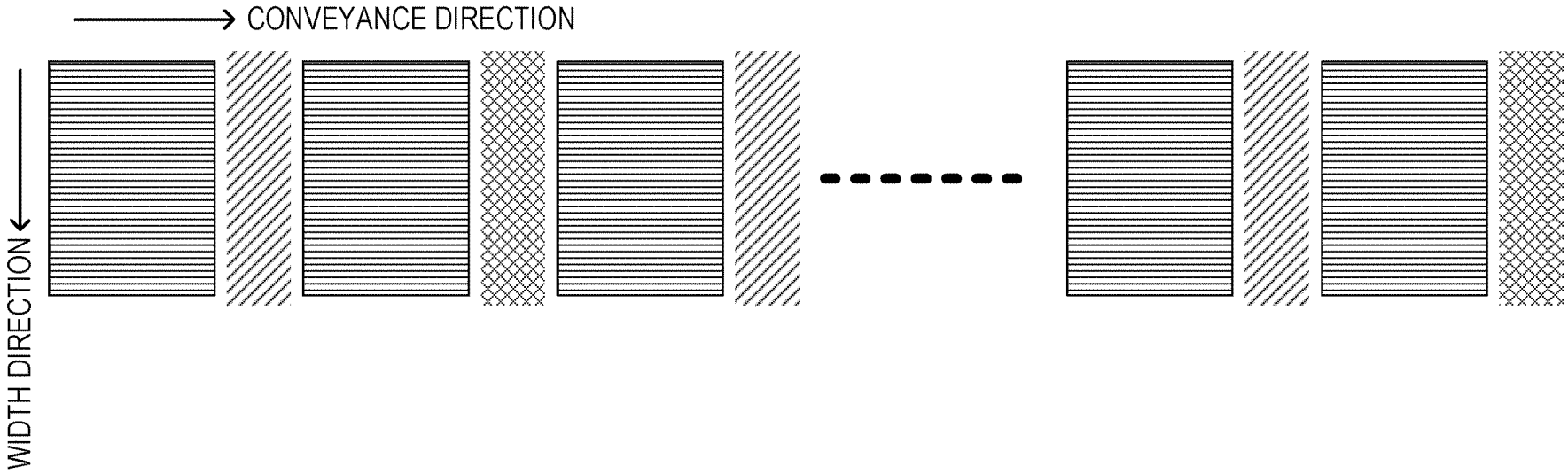
FIG. 15 is a conceptual diagram showing a state in which the pattern of FIG. 9A that is modified in still another form is repeated.

FIG. 15 shows a state in which the pattern of FIG. 9A is modified in still another form, is repeated. A portion of the gap region and both end regions are removed. For example, if the width of the paper is wide and both end regions are not able to be provided, the patch printing region of the form in FIG. 15 is provided.

Figure 16:
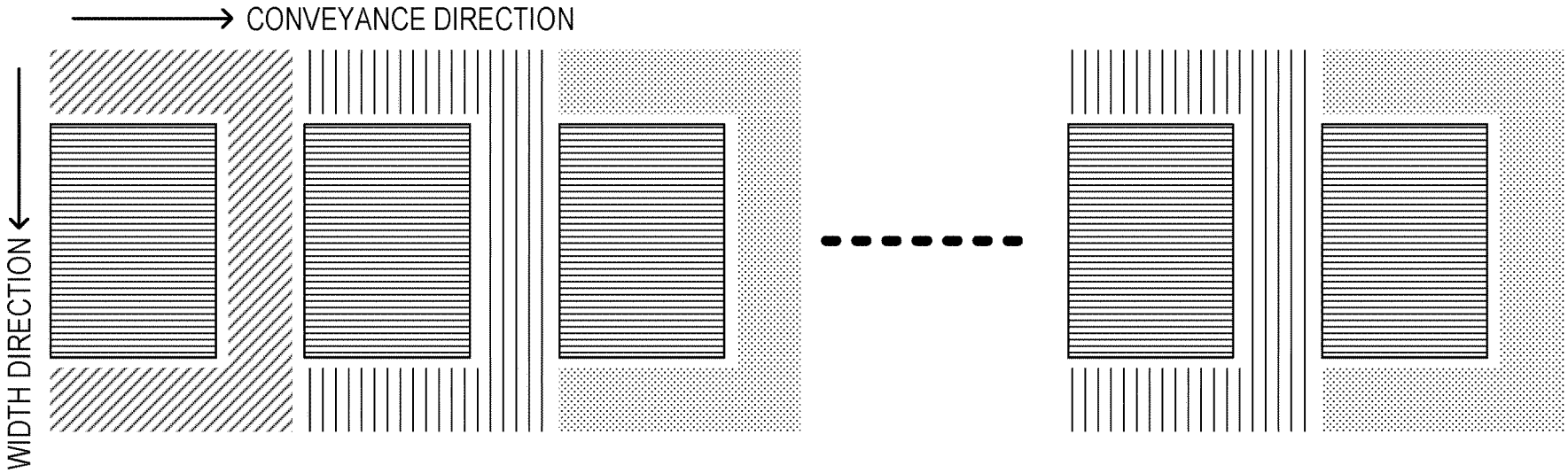
FIG. 16 is a conceptual diagram showing a state in which the pattern of FIG. 9A that is modified in still another form is repeated.

FIG. 16 shows a state in which the pattern of FIG. 9A is modified in still another form, is repeated. The patch printing region for magenta (M), the patch printing region for cyan (C), and the patch printing region for yellow (Y) are repeated with a range of three printing media as one cycle.

Figure 17:
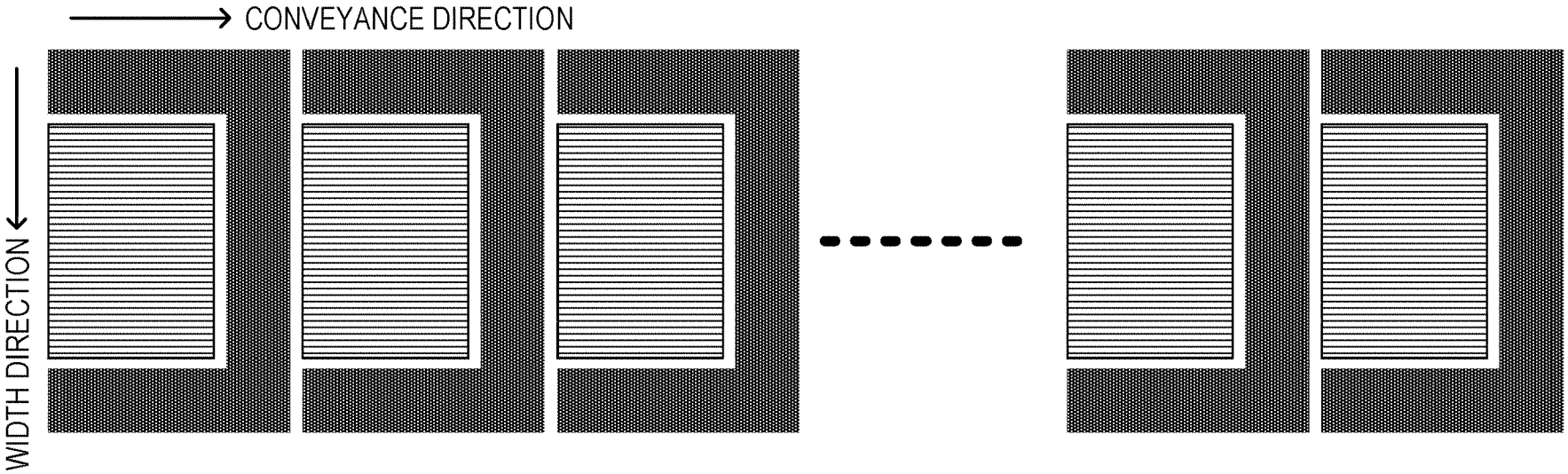
FIG. 17 is a conceptual diagram showing a state in which the pattern of FIG. 9A that is modified in still another form is repeated.

FIG. 17 shows a state in which the pattern of FIG. 9A is modified in still another form, is repeated. The patch printing region for a mixed color of magenta, cyan, and yellow (M+C+Y) is repeated with a range of one printing medium as one cycle.

Figure 18A:
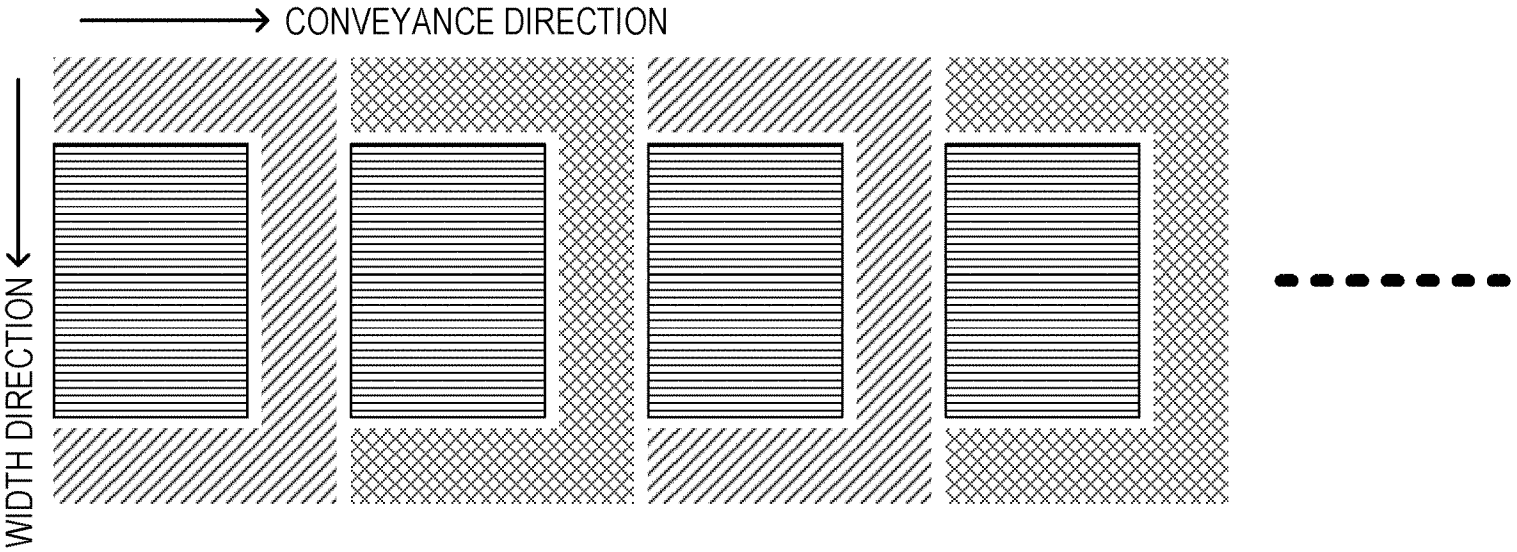
FIG. 18A is a conceptual diagram showing a state in which the pattern of FIG. 9A is repeated.
Figure 18B:
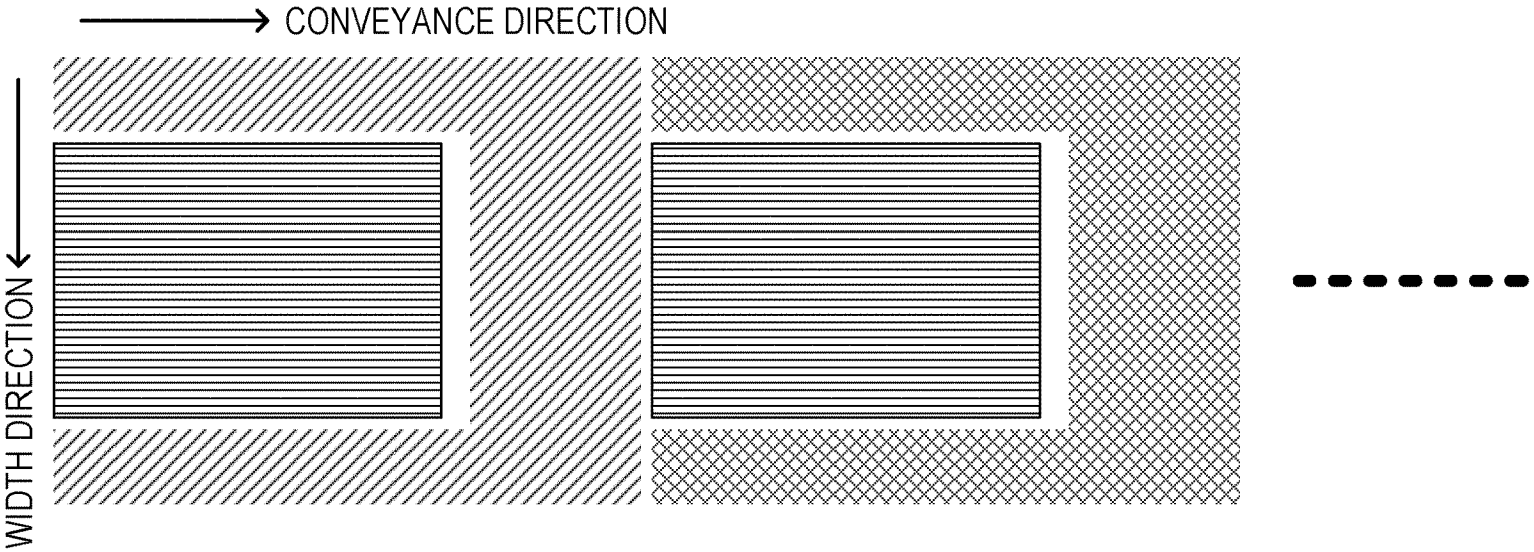
FIG. 18B is a conceptual diagram showing a state in which the pattern of FIG. 9C is repeated.

FIG. 18A is the same as FIG. 11, and it is drawn for comparison with FIG. 18B. FIG. 18B shows a modification of the pattern of FIG. 9C, and the modified pattern is repeated. Both the both end regions and the gap region corresponding to the A3 longitudinal format paper which is a printing medium on the upstream side, are set as a patch printing region for magenta (M), and both the both end regions and the gap region corresponding to the A3 longitudinal format paper which is a printing medium adjacent to the printing medium on the upstream side, are set as a patch printing region for a mixed color of cyan and yellow (C+Y), and the patch printing region for magenta and the patch printing region for the mixed color of cyan and yellow are repeated.

Tenth Embodiment

When the paper is short in the width direction of the intermediate transfer body, the width of both end regions may be widened and the width of the gap region may be narrowed. Conversely, when the paper is long in the width direction of the intermediate transfer body, the width of the both end regions may be narrowed and the width of the gap region may be widened.

Further, for example, when the paper size is too large to provide the both end regions and the gap region of a sufficient area, the printing job may be interrupted and the patch printing region may be provided over the entire surface.

Eleventh Embodiment

In patch printing, a toner density to be applied to the patch region may be adjusted. For example, when the desirable ejection amount of the toner is small, the toner density may be lowered. Also, the toner density may be lowered when a number of repetitions is large.

As also in the ninth embodiment, a plurality of different toners may be overlapped on the same patch region. However, in view of the cleaning ability, it is desirable to make the total density less than 250% when the maximum density is set to 100%.

The methods of the second embodiment through the seventh embodiment are executed for each color. Therefore, in general, there is a case where a toner ejection of some colors is desirable and a toner ejection of the remaining colors is undesirable. For example, when a toner ejection is desirable for only one color, the toner ejection is executed by patch printing for only that one color. When a toner ejection is desirable for only two colors, the toner ejection is executed by patch printing for only two colors. Further, when a toner ejection is desirable for three colors, the toner ejection is executed by patch printing for three colors. In a case of patch printing of two or more colors, a plurality of colors may be overlapped on the same patch printing region, or patch printing of each color may be performed in different patch printing regions.

The consumables discharge device that executes the above-described consumables discharge methods can be realized by a hardware, a software, or a combination thereof. Further, the above-described consumables discharge methods can also be realized by a hardware, a software, or a combination thereof. Here, "being realized by a software" means that it is realized by a computer reading and executing a program.

The program can be stored and supplied to a computer using various types of non-transitory computer readable media. The non-transitory computer readable medium includes various types of tangible storage media. Examples of the non-transitory computer readable medium include a magnetic recording medium (for example, a flexible disk, a magnetic tape, a hard disk drive), a magneto-optical recording medium (for example, a magneto-optical disk), a CD-ROM (read only memory), a CD-R, a CD-R/W, and a semiconductor memory (for example, a mask ROM, a programmable ROM (PROM), an erasable PROM (EPROM), a flash ROM, a random access memory (RAM)). Also, the program may be supplied to the computer by various types of transitory computer readable media. Examples of transitory computer readable medium include electrical signals, optical signals, and electromagnetic waves. The transitory computer readable medium can supply a program to a computer via a wired communication path such as a wire and an optical fiber, or a wireless communication path.

The present disclosure may be embodied in various other forms without departing from the spirit or characteristics of the present disclosure. Therefore, each of the above-described embodiments is merely an example, and it is not desirable to be interpreted restrictively. The scope of the present disclosure is indicated by the scope of claims and is not bound in any way in the text of the specification. Furthermore, all variations and modifications falling within the scope of the claims are within the scope of the present disclosure.

The present disclosure can be used for forcibly discharging toner in an image forming apparatus.

The present disclosure contains subject matter related to that disclosed in Japanese Priority Patent Application JP 2018-072454 filed in the Japan Patent Office on Apr. 4, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A consumables discharge device that discharges toner via an image carrier and an intermediate transfer body, comprising:

a patch forming unit that forms a patch in a patch printing region to be formed on the intermediate transfer body via the image carrier by using the toner discharged from a developer tank after adjusting a range of the patch printing region in one or both of a gap region existing between image forming regions adjacent to each other of the intermediate transfer body and both end regions adjacent to both ends of an image forming region in a width direction of the intermediate transfer body, based on one or both of a size and a direction of a recording medium to be printed as input information.

2. The consumables discharge device according to claim 1, wherein the input information for performing the adjustment also includes a distance between recording media adjacent to each other on the intermediate transfer body, other than one or both of the size and the direction of the recording medium to be printed.

3. The consumables discharge device according to claim 1, wherein the input information for performing the adjustment also includes a distance between recording media adjacent to each other on the intermediate transfer body and a width of the intermediate transfer body, other than one or both of the size and the direction of the recording medium to be printed.

4. The consumables discharge device according to claim 1, further comprising:

a range adjustment unit that adjusts the range of the patch printing region so as to cover both of the region between recording media and the both end regions when the input information for performing the adjustment satisfies a first predetermined condition.

5. The consumables discharge device according to claim 1, further comprising:

a range adjustment unit that adjusts the range of the patch printing region so as to be formed only in the both end regions when the input information for performing the adjustment satisfies a second predetermined condition which is identical with or different from a first condition.

6. The consumables discharge device according to claim 1, further comprising:

a range adjustment unit that adjusts the range of the patch printing region so as to be formed only in the region between recording media when the input information for performing the adjustment satisfies a third predetermined condition which is identical with or different from a first condition and identical with or different from a second condition.

7. The consumables discharge device according to claim 1, further comprising:

a range adjustment unit that adjusts the range of the patch printing region so as to be formed in an entire predetermined range of the intermediate transfer body when the input information for performing the adjustment satisfies a fourth predetermined condition which is identical with or different from a first condition, identical with or different from a second condition, and identical with or different from a third condition.

8. The consumables discharge device according to claim 1, further comprising:

a range adjustment unit that adjusts a patch printing region of each color so that ranges of patch printing regions of at least some toner colors out of a plurality of toner colors overlap.

9. The consumables discharge device according to claim 1, further comprising:

a density adjustment unit that adjusts a toner density in the patch printing region.

10. The consumables discharge device according to claim 9, wherein the density adjustment unit adjusts the toner density in the patch printing region based on a desirable ejection amount of the toner.

11. The consumables discharge device according to claim 10, further comprising:

a discharge amount calculation unit that obtains the desirable discharge amount of the toner based on at least one of a cumulative number of printed sheets or a development rotational number counter after replacing a developer in the developer tank, a latest average printing ratio, and a continuous drive time retraced to past from present.

12. The consumables discharge device according to claim 1, further comprising:

a frequency adjustment unit that adjusts a frequency to repeat the patch printing region.

13. The consumables discharge device according to claim 12, wherein the density adjustment unit adjusts the frequency to repeat the patch printing region based on the desirable ejection amount of the toner.

14. The consumables discharge device according to claim 1, further comprising:

an execution control unit that determines whether or not a toner ejection is desirable based on at least one of a cumulative number of printed sheets or a development rotational number counter after replacing a developer in the developer tank, a latest average printing ratio, and a continuous drive time retraced to past from present.

15. A multifunction machine comprising the consumables discharge device according to claim 1.

16. An image forming apparatus comprising the consumables discharge device according to claim 1.

17. A storage medium storing program that causes a computer to function as the consumables discharge device according to claim 1.

18. A consumables discharge method that discharges toner via an image carrier and an intermediate transfer body, the method comprising:

forming a patch in a patch printing region to be formed on the intermediate transfer body via the image carrier by using the toner discharged from a developer tank after adjusting a range of the patch printing region in one or both of a gap region existing between image forming regions adjacent to each other of the intermediate transfer body and both end regions adjacent to both ends of an image forming region in a width direction of the intermediate transfer body, based on one or both of a size and a direction of a recording medium to be printed as input information.

* * * * *